US007054580B2

(12) United States Patent
Nakashige

(10) Patent No.: US 7,054,580 B2
(45) Date of Patent: May 30, 2006

(54) IMAGE READER APPARATUS AND CYLINDER SHAPED LAMP USED FOR THE SAME

(75) Inventor: Fumihiro Nakashige, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 181 days.

(21) Appl. No.: 10/763,347

(22) Filed: Jan. 26, 2004

(65) Prior Publication Data

US 2004/0151519 A1 Aug. 5, 2004

(30) Foreign Application Priority Data

Jan. 27, 2003 (JP) ..... 2003-016976
Sep. 5, 2003 (JP) ..... 2003-314600

(51) Int. Cl.
*G03G 15/04* (2006.01)

(52) U.S. Cl. ..... 399/221; 355/71; 399/211

(58) Field of Classification Search ..... 399/211, 399/212, 220, 221; 355/71
See application file for complete search history.

(56) References Cited

U.S. PATENT DOCUMENTS 3,920,331 A * 11/1975 Kurita et al. ..... 399/220 X
4,937,613 A * 6/1990 Sawaki et al. ..... 399/221
5,873,308 A * 2/1999 Taira ..... 399/211 X
6,078,042 A * 6/2000 Fellows ..... 250/252.1
6,369,875 B1 * 4/2002 Ito et al. ..... 399/211 X

FOREIGN PATENT DOCUMENTS

JP 01-224742 A * 9/1989
JP 9-130540 5/1997
JP 2001-222076 8/2001

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An image reader apparatus for lighting a manuscript surface of a manuscriptin a line state, and for image-forming a reflection light from a reading part of the manuscript surface lighted in the line state, to an image sensor, by an image forming lens which forms a part of a scaled down optical system so that an image of the manuscript is read, includes an irradiation opening part and an optical element. The irradiation opening part is for irradiating a lighting light to an outside part, which is formed at the light source. The optical element for attenuating a light amount so as to be permeated, which is provided between the irradiation opening part and the manuscript stand.

15 Claims, 23 Drawing Sheets

IMAGE READER APPARATUS AND CYLINDER SHAPED LAMP USED FOR THE SAME

BACKGROUND OF THE INVENTION

1. Field of the Invention

The present invention relates to image reader apparatuses such as scanners used for digital copy machines and cylinder shaped lamps used for them.

2. Description of the Related Art

Conventionally, as shown in FIG. 1, in an image reader apparatus, a manuscript surface 3 of a manuscript 2 which is set on a manuscript stand 1 (a contact glass) is lighted by a cylinder shaped lamp 4 so as to form a line. A reflection light from a reading part 3A forming a line of the manuscript surface 3 lighted so as to form a line is image-formed to an imaging element 6 by an image-formation lens 5 which forms one part of a contraction optical system (an image-formation optical system), so that an image of the manuscript 2 is read.

A Xenon pipe is used as the cylinder shaped lamp 4, for example. An irradiation opening part 4A is provided at the Xenon pipe. The reading part 3A of the manuscript surface 3 is directly lighted by a lighting light P1 outgoing through an irradiation opening part 4A and lighted by a reflection lighting light P1' reflected by a reflector 7.

The refection light from the reading part 3A is led to the contraction optical system by a turning mirror 8, so that the reflection light is image-formed to the imaging element 6 by the image-forming lens 5. The cylinder shaped lamp 4 and the reflector 7 move while scanning in a direction (a sub scanning direction) perpendicular to a direction (a main scanning direction) extending so as to make a line of the reading part 3A, so that image reading is implemented by a line sequence.

In reading of the manuscript image by the scanner, a quality of image reading is determined by photographic sensitivity of the imaging element 6 such as a charge coupled device (CCD), an optical performance of the contraction optical system such as the lens, a reading position, an emission amount of the cylinder shaped lamp 4, a light amount of a synthetic lighting light including the cylinder shaped lamp 4 and the manuscript surface 3. In a case where a distance from a lighting optical system including the cylinder shaped lamp 4 and the reflector 7 to the manuscript surface 3 is short, the lighting light which is diffused reflection at the manuscript surface 3 irradiates the reflector 7, the cylinder shaped lamp 4, and other optical parts provided inside of the housing of the image reader apparatus. As a result of this, the above-mentioned lighting light becomes a secondary lighting light which irradiates again to the reading part 3A of the manuscript surface 3, so that a flare phenomenon based on the change of the reading image signal is generated.

Accordingly, in the image reader apparatus, in order to prevent the generation of the flare due to exposure of the reading part 3A of the manuscript surface 3, it is necessary to prevent excess light other than the lighting light for exposure from being incident on the reading part 3A of the manuscript surface 3. Because of this, a structure providing glare protection is known conventionally. Furthermore, while a distance from the cylinder shaped lamp 4 to the manuscript surface 3 is long, a light collector lens is provided so as to prevent reduction of the amount of lighting light at the reading part 3A due to the long distance. A transparent opening part and a glare protection part are formed at the light collector lens, so that the reading part 3A can be lighted in a concentrated manner. As a result of this the flare is prevented from being generated. See Japan laid-open patent application H09-130540.

In another conventional art device, a lighting unevenness due to the reflection light is prevented from being generated by regarding a property of the exposure light amount in a direction where the line of the reading part 3A extends as a specific condition. See Japan laid-open patent application 2001-222076.

That is, as shown in FIG. 1, a part P2' of the lighting light P1 which is diffused at the reading part 3A returns inside of the Xenon pipe through the irradiation opening part 4A and reflects at an inside wall surface 4B, so as to become a secondary lighting light P3' which secondarily lights again the reading part 3A through the irradiation opening part 4A. Based on the secondary lighting light P3', a flare phenomenon is generated.

Once the flare phenomenon is generated, even if there is the reading part 3A having the same manuscript density, the reading image signal by the scanner is changed due to the density difference in the vicinity of the reading part 3A. This is because the reflection light amount at the manuscript surface 3 of the secondary lighting light P3' is changed based on the manuscript density. This flare phenomenon frequently occurs at a part where the manuscript density is drastically changed.

An example of this is explained below. That is, as roughly shown in FIG. 2-(*a*), the cylinder shaped lamp 4 is scanned in the sub scanning direction so as to be scanned on the manuscript surface 3 and the image of the manuscript surface 3 is read. The manuscript surface 3 has a black pattern part 8A, a black pattern part 8B, a white pattern part 8C between the black pattern part 8A and the black pattern part 8B, and a white pattern part 8D which is a remaining part.

In a case where the cylinder shaped lamp 4 is scanned in the sub scanning direction of the manuscript surface 3, turning attention to a designated point Q of the reading part 3A extending in a line shape, a diffusion reflection light from a remaining point Q' of the reading part 3A extending in a line shape, and a part of a diffusion reflection light from a vicinity in front and behind in the sub scanning direction put between the reading part 3A extending in a line shape, return inside of the cylinder shaped lamp 4 through the irradiation opening part 4A and reflect at the inside part wall surface 4B, so as to become a secondary lighting light P3' which lights again to the point Q of the reading part 3A. In a case where the manuscript density is uniform, for example, the cylinder shaped lamp 4 is scanning the white pattern part 8D, there is no change of the light amount of the secondary lighting light P3'. Hence, in a case where the manuscript image is read out, the image 8D' becomes uniformly white as shown in FIG. 2-(*b*).

However, in a case where the black patterns 8A and 8B of the manuscript surface 3 are read out, turning attention to a point R of the white pattern part 8C corresponding to the point Q of the white pattern part 8D, due to the existence of the black patterns 8A and 8B, the light amount of the diffusion reflection light from a remaining point of the reading part 3A having a line form and the diffusion reflection light from front and behind vicinities in a sub direction put between the line shape reading part 3A is smaller than the light amount when the white pattern part 8D of the manuscript surface 3 is read.

Meanwhile, the secondary lighting light P3' is diffusion reflected by the reading part 3A having a line form, returns inside of the cylinder shaped lamp 4 through the irradiation opening part 4A, reflects at the inside part wall surface 4B, and lights again a point R of the reading part 3A. Therefore, the light amount of the secondary lighting light P3' is smaller than the light amount when the white pattern part 8D is read. Hence, the white pattern part image 8C' between the black pattern part image 8A' and the black pattern part image 8B' is darker than the white pattern part image 8D'. The substantially same phenomenon is generated at the white pattern part 9' in the vicinity of the interface area of the white pattern part 8D and the black patterns 8A and 8B in a sub scanning direction.

Therefore, in a design of the image reader apparatus, although the optical system part arranged inside of the housing is painted black and a layout of the respective optical system parts is devised, it is difficult to eliminate relighting at the reading part by the secondary lighting light. Hence, that causes difficulty for improvement of the quality of reading an image.

In the image reader apparatus shown in the above-mentioned laid opened patent application H09-130540, although the diffusion reflection light of the lighting light reflected at the reading part 3A is prevented from returning to the cylinder shaped lamp 4, it is not possible to prevent the generation of the flare phenomenon in the manuscript image by using the optical parts with a low price.

SUMMARY OF THE INVENTION

Accordingly, it is a general object of the present invention to provide a novel and useful image reader apparatus and a cylinder shaped lamp used for the same, in which one or more of the problems described above are eliminated.

Another and more specific object of the present invention is to provide an image reader apparatus by which the generation of the flare in the manuscript image which is read is mainly prevented and deterioration of the read image quality is avoided with a compact structure by using an optical part with a low price.

The above objects of the present invention are achieved by an image reader apparatus for lighting a manuscript surface of a manuscript, which is set on a manuscript stand, in a line state by a light source part, and for image-forming a reflection light from a reading part of the manuscript surface lighted in the line state, to an image sensor, by an image forming lens which forms a part of a scaled down optical system so that an image of the manuscript is read, including:

an irradiation opening part for irradiating a lighting light to an outside part, which is formed at the light source; and an optical element for attenuating a light amount so as to be permeated, which is provided between the irradiation opening part and the manuscript stand.

The above objects of the present invention are also achieved by an image reader apparatus for lighting a manuscript surface of a manuscript, which is set on a manuscript stand, in a line state by a cylinder shaped lamp, and for image-forming a reflection light from a reading part of the manuscript surface lighted in the line state, to an image sensor, by an image forming lens which forms a part of a scaled down optical system so that an image of the manuscript is read, including:

an irradiation opening part for irradiating a lighting light to an outside part, which is formed at the cylinder shaped lamp and extends in a direction which the lamp extends; and an optical element for attenuating a light amount so as to be permeated, which is provided between the irradiation opening part and the manuscript stand.

According to the above-mentioned inventions, it is possible to prevent the flare generated due to the reflection light from the manuscript surface of the lighting light being re-reflected inside the lamp so as to light the manuscript again, namely, the change of reading density at the interface part of the manuscript density.

The cylinder shaped lamp may be an Xenon lamp, and the optical element may be provided at the irradiation opening part.

According to the above-mentioned invention, in addition to the above-mentioned effect, since a semi-permeable optical element is directly formed at the irradiation opening part of the Xenon lamp, it is possible to easily arrange the layout of the lighting optical system (lighting light source) including the Xenon lamp and so as to make the lighting optical system small.

The cylinder shaped lamp may be moved in a sub scanning direction perpendicular to a main scanning direction in which the cylinder shaped lamp extends, so that the manuscript surface of the manuscript is read. The optical element may be formed by an ND filter having a surface to which a light absorbing process is applied. The optical element may be formed by an ND filter having a surface to which a black net point process is applied.

According to the above-mentioned inventions, it is possible to reduce the lighting amount of the light which lights the manuscript by re-reflecting the reflection light reflected on the manuscript surface with the semi-permeable optical element. Therefore, it is possible to further change of the strength of the lighting light based on the manuscript density being smaller.

A permeability rate of the optical element may be set corresponding to an emission light strength distribution in a direction which the cylinder shaped lamp extends, so that the permeability rate is set small at a position where the emission light strength distribution is high, and the permeability rate is set large at a position where the emission light strength distribution is low.

According to the above-mentioned invention, it is possible to achieve uniformity of the amount of the lighting light in a line direction of the reading part having a line shape. Hence, it is possible to reduce the lighting unevenness in a line direction of the reading part, so that it is possible to achieve high quality image reading.

A reflector may be provided so as to face the irradiation opening part of the cylinder shaped lamp, so that a lighting light from the cylinder shaped lamp is reflected and is led from a direction facing a direct lighting light that is directly led from the cylinder shaped lamp to the reading part, to the reading part, the optical element may have a permeable area where the direct lighting light which is directly led from the cylinder shaped lamp to the reading part is permeated, and a permeable area where the lighting light which is led to the reflector is permeated, and a permeability rate of the permeable area where the lighting light which is led to the reflector is permeated may be larger than a permeability rate of the permeable area where the direct lighting light is permeated.

A reflector may be provided so as to face the irradiation opening part of the cylinder shaped lamp, so that a lighting light from the cylinder shaped lamp is reflected and is led from a direction facing a direct lighting light, which direct lighting light is directly led from the cylinder shaped lamp to the reading part, to the reading part, the optical element may have a permeable area where the direct lighting light which is directly led from the cylinder shaped lamp to the reading part is permeated, and a permeable area where the lighting light which is led to the reflector is permeated, and a permeability rate of the permeable area where the lighting light which is led to the reflector is progressively larger, from the permeable area where the direct lighting light which is directly led from the cylinder shaped lamp to the reading part is permeated, to the permeated area where the lighting light which is led to the reflector is permeated.

According to the above-mentioned invention, it is possible to secure a balance between the strength of the direct lighting light by the cylinder shaped lamp and the strength of the reflection lighting light by the reflector, so that it is possible to achieve further higher reading quality of the manuscript image.

The optical element may show a color having a supplemental relationship with an emission color of the cylinder shaped lamp.

The optical element may cut a lighting light in an infrared wave length area.

According to the above-mentioned inventions, it is possible to make a white color of the lighting light irradiated to the manuscript image, so that it is possible to improve the image quality of the color image reader apparatus.

The optical element may be formed by a polarization filter.

According to the above-mentioned invention, a polarization filter is used instead of the semi-permeable optical element. Hence, the reflection light, which is reflected at the manuscript surface and returns to the cylinder shaped lamp, is cut efficiently. Hence, it is possible to modify of the strength of the lighting light by making the manuscript density further smaller.

The optical element may be provided so as to be tilted against a segment perpendicularly connecting a center axis of the cylinder shaped lamp and the reading part.

According to the above-mentioned invention, the semi-permeable optical element is provided so as to be tilted. Hence, the reflection light which is reflected at the reading part of the manuscript surface and goes toward the semi-permeable optical element is sent in a different direction from the reading part. Therefore, it is possible to achieve further higher quality of image reading.

A revolving mechanism for rotating the optical element in a state where a rotational shaft situated in parallel to a direction in which the cylinder shape extends is a center of rotation, so that the optical element can be fixed.

According to the above-mentioned invention, it is possible to adjust the tilt of the semi-permeable optical element. Therefore, it is possible to achieve further higher quality of the image.

The optical element may be provided so as to be separated from the cylinder shaped lamp, and has a surface facing the cylinder shaped lamp that is a curved surface which curves along an external form of the cylinder shaped lamp.

According to the above-mentioned invention, it is possible to control a temperature rise of the semi-permeable optical element due to the lighting light from the cylinder shaped lamp.

Also, the above mentioned objects of the present invention are achieved by an image reader apparatus for lighting a manuscript surface of a manuscript which is set on a manuscript stand, in a line state by a cylinder shaped lamp, and for image-forming a reflection light from a reading part of the manuscript surface lighted in the line state, to an image sensor, by an image forming lens which forms a part of a scaled down optical system so that an image of the manuscript is read, including:

an irradiation opening part for irradiating a lighting light to an outside part, which is formed at the cylinder shaped lamp and extends in a direction which the lamp extends; and an attenuation film, provided at the irradiation opening part, for attenuating a reflection light which is reflected from the reading part of the manuscript surface, is incident on an inside part of the cylinder shaped lamp through the irradiation opening part, and is reflected at an inside part wall surface of the cylinder shaped lamp so as to be led to the reading part through the irradiation opening part.

According to the above-mentioned invention, it is possible to make the light source part compact.

Also, the above mentioned objects of the present invention are achieved by a cylinder shaped lamp, including:

a tube wall;

an irradiation opening part, formed at a part of the tube wall, for lighting a reading part of a manuscript surface of a manuscript, which is set on a manuscript stand, in a line state; and an attenuation film, provided at the irradiation opening part, for attenuating a reflection light which is reflected from the reading part of the manuscript surface, is incident on an inside part of the cylinder shaped lamp through the irradiation opening part, and is reflected at an inside part wall surface of the cylinder shaped lamp so as to be led to the reading part through the irradiation opening part.

The above mentioned objects of the present invention are also achieved by a cylinder shaped lamp, including:

a tube wall covered with a protection tube;

a irradiation opening part, formed at the tube wall, for lighting a reading part of a manuscript surface of a manuscript, which is set on a manuscript stand, in a line state; and an optical element, put between the tube wall and the protection tube by the protection tube so as to be fixed, for attenuating a reflection light which is reflected from the reading part of the manuscript surface, is incident on an inside part of the cylinder shaped lamp through the irradiation opening part, and is reflected at an inside part wall surface of the cylinder shaped lamp so as to be led to the reading part through the irradiation opening part.

The above mentioned objects of the present invention are also achieved by a cylinder shaped lamp, including:

a tube wall covered with a protection tube;

an irradiation opening part, formed at the tube wall, for lighting a reading part of a manuscript surface of a manuscript, which is set on a manuscript stand, in a line state; wherein the protection tube functions as an optical element for attenuating a reflection light which is reflected from the reading part of the manuscript surface, is incident on an inside part of the cylinder shaped lamp through the irradiation opening part, and is reflected at an inside part wall surface of the cylinder shape so as to be led to the reading part through the irradiation opening part.

According to the above-mentioned inventions, it is possible to provide a cylinder shaped lamp having a compact structure by which the generation of the flare phenomenon based on the secondary lighting light is efficiently reduced.

Also, the above mentioned objections of the present invention is achieved by an image reader apparatus for lighting a manuscript surface of a manuscript, in a line state by a cylinder shaped lamp, and for image-forming a reflection light from a reading part of the manuscript surface lighted in the line state, to an image sensor, by an image forming lens which forms a part of a scale down optical system so that an image of the manuscript is read, including:

an optical element having a whole permeable area and a semi-permeable area, wherein the whole permeable area faces the reading part from an optical axis direction of the image forming optical system, and the semi-permeable area is located between the manuscript surface and the cylinder shaped lamp, and the lighting light formed by the cylinder shaped lamp is attenuated so as to be permeated at the manuscript surface in the semi-permeable area.

According to the above-mentioned invention, it is possible to prevent the flare generated due to the reflection light from the manuscript surface of the lighting light being re-reflected inside the lamp so as to light the manuscript again, namely, the change of reading density at the interface part of the manuscript density such as the change of reading density at the interface part of a letter manuscript.

The semi-permeable surface may have a plurality of regular net points having constant sizes.

According to the above-mentioned invention, it is possible to make a surface of the optical element glossy and the reflection at the surface small. Hence, it is possible to reduce the lighting amount of the light which lights the manuscript by re-reflecting the reflection light reflected on the manuscript surface with the optical element. Therefore, it is possible to obtain the lighting light having a high quality.

The optical element may be a contact glass located between the image sensor and the manuscript, and the semi-permeable area may be formed by applying a semi-permeable process to the contact glass.

According to the above-mentioned invention, since the semi-permeable area is formed at the contact glass, it is not necessary to provide an optical element exclusively for reduction of the secondary lighting light. Hence, it is possible to easily make a layout of the optical system and obtain a picture image of the manuscript having a high quality.

The optical element may be adjustable in a direction parallel to the manuscript surface.

According to the above-mentioned invention, the position of the optical system can be adjusted based on the position of the optical system. Therefore, it is possible to adjust the position of the whole permeable area corresponding to the position of the picture image element, so that it is possible to further achieve the improvement of the quality of the reading picture image.

The semi-permeable area of the contact glass may be formed at a surface of a side facing the image sensor.

According to the above-mentioned invention, it is possible to efficiently cut the lighting light which is reflected in the vicinity of the reading part of the manuscript surface and is not necessary for reading the image. Therefore, it is possible to further reduce the flare so that the manuscript image having a high quality can be obtained.

The image reader apparatus may further include a reflector receiving a part of the lighting light from the cylinder shaped lamp and reflecting the light to the manuscript so that the manuscript surface is lighted, wherein a first semi-permeable area may be provided at a side of the cylinder shaped lamp side of the optical element and a second semi-permeable area is provided at a side of the reflector via the whole permeable area, and a permeability rate of the second semi-permeable area at the reflector side may be higher than a permeability rate of the first semi-permeable area at the cylinder shaped lamp side.

According to the above-mentioned invention, in a case where the reflector for lighting is provided, it is possible to make a balance of the light amount of the secondary lighting light between the cylinder shaped lamp side and the reflector side for lighting. Hence, even if the attenuation amount of the light amount of the primary lighting light is not made large, it is possible to efficiently reduce the generation of the flare.

A permeability rate of the semi-permeable area of the optical element may be set corresponding to an emission light strength distribution in a direction which the cylinder shaped lamp extends, so that the permeability rate is set small at a position where the emission light strength distribution is high, and the permeability rate is set large at a position where the emission light strength distribution is low.

According to the above-mentioned invention, it is possible to achieve uniformity of distribution of the light amount of the lighting light on the manuscript in an extending direction of the cylinder shaped lamp, so as to obtain an image having a further higher quality.

A color of the optical element may have a supplemental relationship with an emission light color of the cylinder shaped lamp.

According to the above-mentioned invention, since the optical element has a color having a supplemental color relationship with a color of the emission of light of the cylinder shaped lamp, the lighting light which lights the manuscript surface has a white color. In a case of a full color image reader apparatus, it is possible to obtain the image having a higher quality.

The contact glass may have a non-permeable film formed at an area other than the reading area common to the image sensor at a surface of a side facing the manuscript surface.

According to the above-mentioned invention, since the non-permeable film is formed at an area other than the reading part of a surface facing the manuscript surface of the contact glass, the reflection light from a part other than the reading part can be cut regardless of the manuscript density. Furthermore, since the semi-permeable area is provided, the secondary lighting light from the cylinder shaped lamp can be reduced so that the flare phenomenon can be further reduced. As a result of this, it is possible to obtain the manuscript image having a high quality.

The permeability rate at the permeable area of the optical element may be smaller as being far from the reading part in a state where the reading part is a center part.

According to the above-mentioned invention, since a permeability rate at the permeable area of the optical element is small as being far from the reading part in a state where the reading part is a center part, it is possible to eliminate the lighting light which does not contribute as the primary lighting light. As a result of this, it is possible to reduce the light amount of the secondary lighting light, so that the flare phenomenon can be further reduced and the semi-permeable area is consecutively reduced from the permeability rate of the whole permeable area. Hence, even if there is a scatter in a position relationship between the picture image element and the reader position, most of the lighting light permeates the vicinity of the whole permeable area of the semi-permeable area. Therefore, it is possible to light the manuscript surface without adjusting the position of the optical element, so that it is possible to prevent the difficulty in image reading.

The above objects of the present invention are achieved by an image reader apparatus for lighting a manuscript surface of a manuscript, in a line state by a cylinder shaped lamp, and for image-forming a reflection light from a reading part of the manuscript surface lighted in the line state, to an image sensor, by a image forming lens which forms a part of a scaled down optical system so that an image of the manuscript is read, including:

an optical element having a diffusion reflection surface by which a reflection light reflected from the manuscript surface is diffusion reflected to the manuscript surface, provided at a position where a lighting light leading from the cylinder shaped lamp to the manuscript surface is not blocked and an optical path of the image forming optical system is not blocked, so as to be separated from the manuscript surface.

According to the above-mentioned invention, the reflection light reflected at the manuscript surface is widely diffusion reflected by a diffusion reflection surface and the diffusion reflection light widely relights the manuscript surface. Therefore, the secondary lighting light due to the light and shade of the manuscript is relatively diluted. As a result, it is possible to prevent the change of reading density at the interface part of the manuscript density such as the change of reading density at the interface part of a letter manuscript.

The above objects of the present invention are achieved by an image reader apparatus for lighting a manuscript surface of a manuscript, in a line state by a cylinder shaped lamp, and for image-forming a reflection light from a reading part of the manuscript surface lighted in the line state, to an image sensor, by a image forming lens which forms a part of a scaled down optical system so that an image of the manuscript is read, include:

an optical element having a diffusion reflection surface by which a lighting light injected from the cylinder shaped lamp is diffusion-reflected in a direction far from the manuscript surface, provided at a position where the lighting light leading from the cylinder shaped lamp to the manuscript surface is not blocked and at a position of an opposite side to a surface facing the manuscript surface of the contact glass.

According to the above-mentioned invention, even if the lighting light is not reflected at the manuscript surface, a part of the lighting light injected from the cylinder shaped lamp is diffused at the diffusion reflected surface and the diffusion light widely lights the manuscript surface. Therefore, the secondary lighting light due to the light and shade of the manuscript is relatively diluted.

The image reader apparatus may further include a mountain part and a valley part which have a triangle cross section and extend in a main scanning direction which the cylinder shaped lamp extends, and a plurality of the mount parts and the valley parts may be provided alternatively in a sub scanning direction perpendicular to the main scanning direction.

According to the above-mentioned invention, the diffusion-reflected surface extends in a main scanning direction and has a cross-sectional triangular configuration wherein a mountain part and valley part are provided alternating with each other in a sub scanning direction. Hence, the lighting light reflected at the manuscript surface is reflected in a direction far from the original reflection position, so that the manuscript surface is widely lighted.

A pitch from one mountain part to an adjacent mountain part or a pitch from one valley part to an adjacent valley part may be equal to or larger than two times as large as an image reading resolution.

According to the above-mentioned invention, the diffusion reflected surface having a cross-sectional triangular configuration is formed with a sufficiently small pitch against a resolution of the image reading. Hence, it is possible to light further evenly regardless of the light and shade of the manuscript so that the lighting unevenness at a short period can be prevented.

At least two optical elements may be provided so that the optical path of the image forming optical system is put between the optical elements and there is an interval in a direction perpendicular to a direction which the cylinder shaped lamp extends.

According to the above-mentioned invention, an optical path of an image forming optical system is put between the diffusion reflected surfaces and the diffusion reflected surfaces are provided on both sides thereof. Hence, it is possible to light further strongly and widely by the diffusion reflected light. Also, regardless of light and shade of the manuscript, it is possible to light the manuscript surface uniformly. Furthermore, the secondary lighting light is generated from both sides of the reading part. Hence, for example, even if a manuscript, which has a difference in level of paper thickness due to patching, is read out, it is difficult for the shade due to the difference in level to occur. Therefore, it is possible to improve the reading image quality wholly.

The above objects of the present invention are achieved by an image reader apparatus for lighting a manuscript surface of a manuscript, in a line state by a cylinder shaped lamp, and for image-forming a reflection light from a reading part of the manuscript surface lighted in the line state, to an image sensor, by an image forming lens which forms a part of a scale down optical system so that an image of the manuscript is read, including:

an optical element having a diffusion-reflection surface by which a reflection light reflected from the manuscript surface is diffusion reflected to the manuscript surface, provided at a position where the lighting light leading from the cylinder shaped lamp to the manuscript surface is not blocked and an optical path of the image forming optical system is not blocked, so as to be separated from the manuscript surface; and an optical element having a diffusion reflection surface by which a lighting light injected from the cylinder shaped lamp is diffusion-reflected in a direction far from the manuscript surface, provided at a position where the lighting light leading from the cylinder shaped lamp to the manuscript surface is not blocked and at a position of an opposite side to a surface facing the manuscript surface of the contact glass.

According to the above-mentioned invention, the diffusion reflected surface by which the reflection light reflected at the manuscript surface is diffuse reflected toward to the manuscript surface, and another diffusion reflected surface by which the reflection light injected from the cylinder shaped lamp is diffuse reflected toward a direction opposite to the direction toward the manuscript surface so that the manuscript surface is indirectly lighted, are provided. Therefore, it is possible to obtain a stronger lighting light in a wide range regardless of light and shade of the manuscript.

A wider area than the reading part may be lighted by the lighting light.

According to the above-mentioned invention, it is possible to obtain a wide range of the lighting light arriving at the manuscript surface. Hence, it is possible to obtain relighting light in a wider range so that it is possible to light the manuscript surface more uniformly regardless of the light and shade of the manuscript.

The diffusion reflected surface of the optical element may have a supplemental relationship with a color at the peripheral part of the lighting optical system.

According to the above-mentioned invention, the diffusion reflected surface has a supplemental relationship with a color at the peripheral part of the lighting optical system. Hence, a color of synthesized light of the secondary lighting light generated by the diffused surface and the secondary lighting light generated by the peripheral part of the lighting optical system is substantially same as the color of the lighting light of the cylinder shaped lamp. Therefore, it is possible to cause the color of the manuscript to reappear with a higher precision.

Corresponding to a light amount distribution of the lighting light in a main scanning direction, a reflection ratio may be set lower as light strength is higher and the reflection ratio is set higher as the light strength is lower.

According to the above-mentioned invention, corresponding to the light amount distribution of the lighting light on the manuscript in an extending direction of the cylinder shaped lamp, the reflection ratio of the diffused reflection surface is set low in a case of high strength and the reflection ratio of the diffused reflection surface is set high in a case of low strength. Hence, it is possible to make the strength difference between the secondary lighting light generated by a part where the strength of the primary lighting light is high and the secondary lighting light generated by a part where the strength of the primary lighting light is low small. Therefore, it is possible to relieve the lighting unevenness on the manuscript surface due to the strength distribution of the primary lighting light so that it is possible to light the manuscript surface more uniformly.

The diffusion reflection surface may be a curved surface in a state where a curvature center is situated at a side of the manuscript surface.

According to the above-mentioned invention, in a case where the diffusion reflection surface is a plane surface, reflection light which is diffused in a direction far from the manuscript surface can be reflected toward the manuscript surface because the diffusion reflection surface is a curved surface. Therefore, it is possible to concentrate more reflection light on the manuscript surface. Accordingly, it is possible to light the manuscript surface more uniformly regardless of the light and shade of the manuscript.

Other objects, features, and advantages of the present invention will become more apparent from the following detailed description when read in conjunction with the accompanying drawings.

DETAILED DESCRIPTION OF THE PREFERRED EMBODIMENTS

A description of an image reader apparatus and a cylinder shaped lamp for the same, is given below, with reference to the FIGS. 3 through 34 of embodiments of the present invention.

First Embodiment

Figure 1:
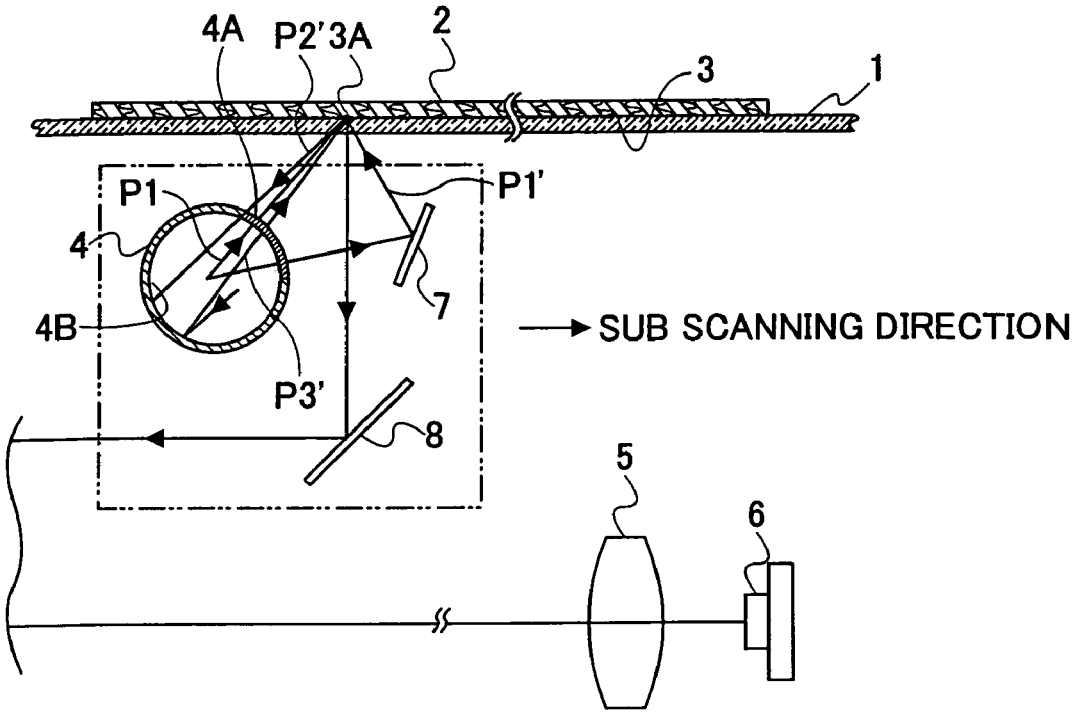
FIG.1 RELATED ART
FIG. 1 is a cross-sectional view for explaining an inconvenience of the related art image reader apparatus.
Figure 2:
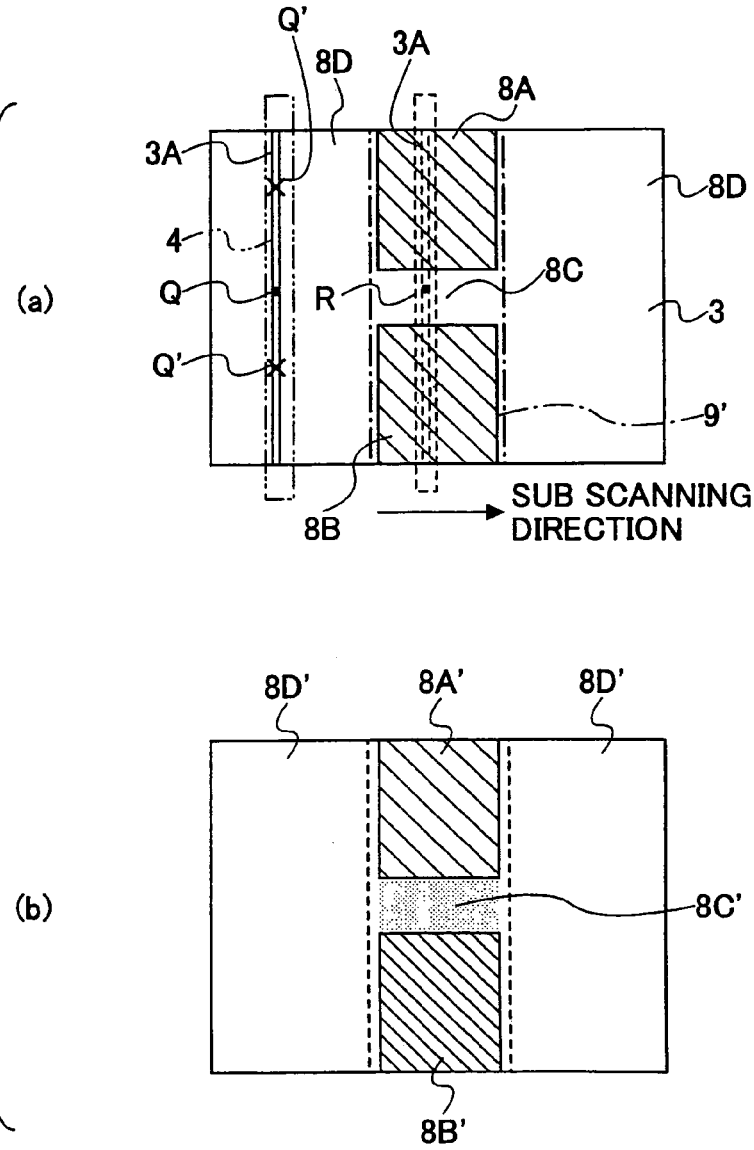
FIG.2 RELATED ART
FIG. 2 is a view for explaining a situation where a flare is generated in the image read out by the related art image reader apparatus shown in FIG. 1; more specifically FIG. 2-(*a*) is a schematic diagram showing a scan state of the image of the manuscript surface and FIG. 2-(*b*) is a cross-sectional view showing a disadvantage of the image obtained by scanning the manuscript surface shown in FIG. 2-(*a*)
Figure 3:
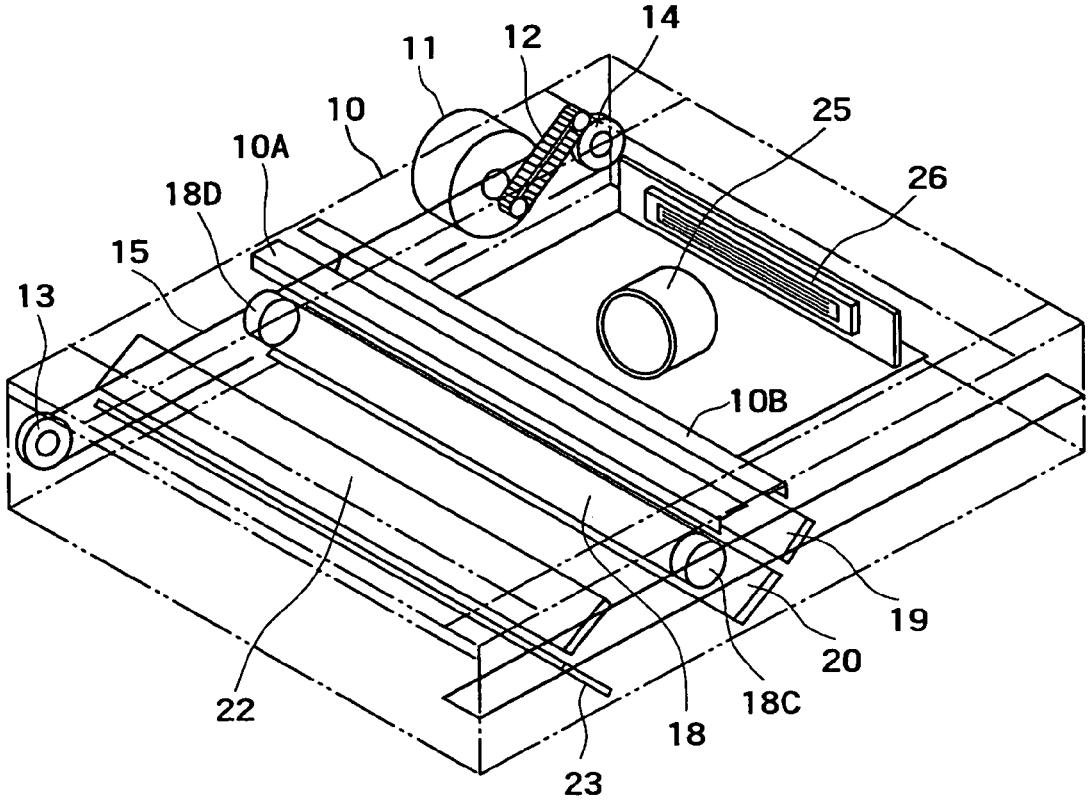
FIG. 3 is a perspective view showing a rough structure of an image reader apparatus of the first embodiment of the present invention.
Figure 4:
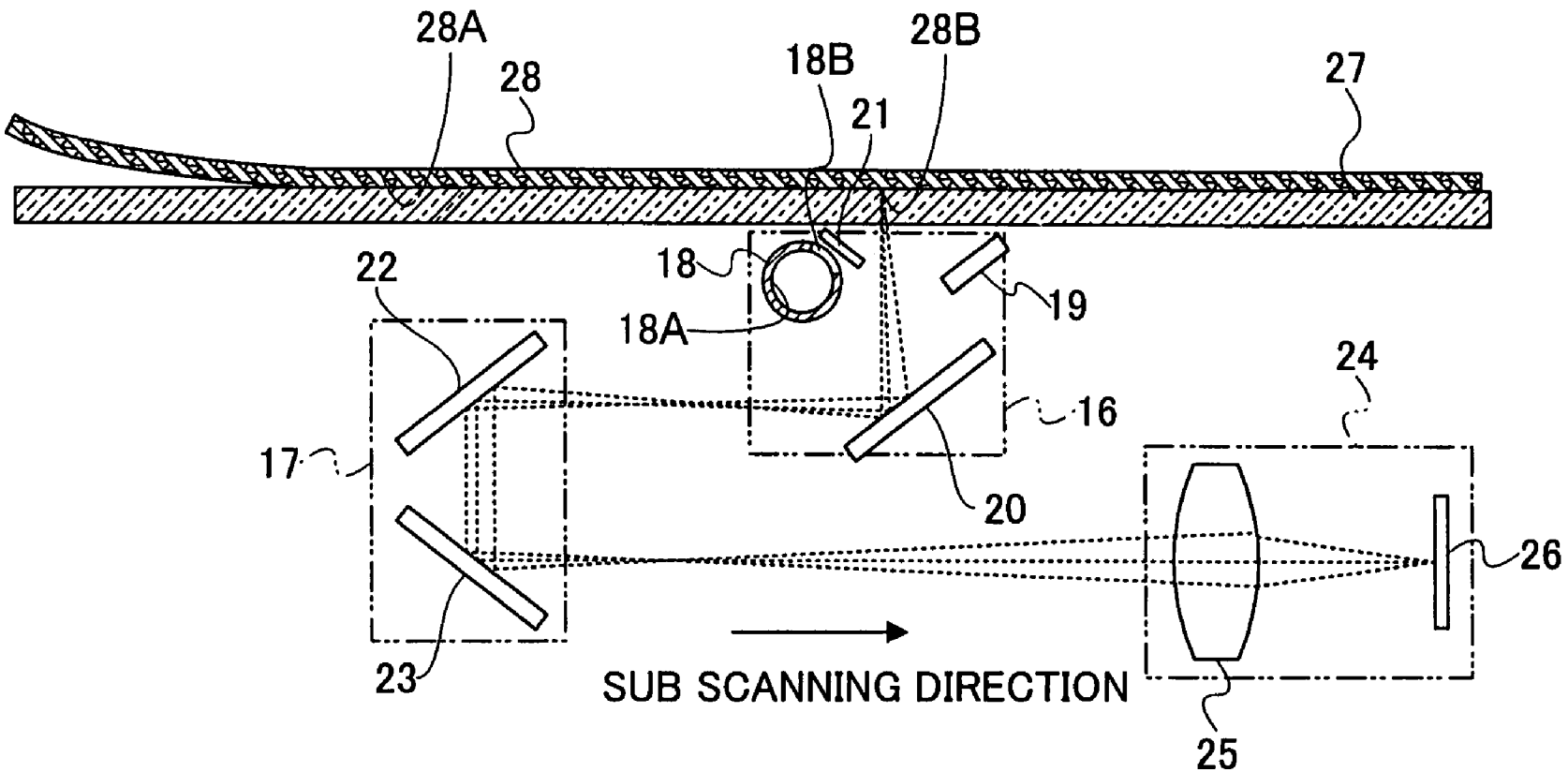
FIG. 4 is a partially enlarged side surface cross-sectional view of the image reader apparatus shown in FIG. 3.

FIG. 3 is a perspective view showing a rough structure of an image reader apparatus of the first embodiment of the present invention. FIG. 4 is a partially enlarged side surface cross-sectional view of the image reader apparatus shown in FIG. 3.

Referring to FIG. 3, a housing 10 of the image reader apparatus of the first embodiment of the present invention includes a driving motor 11, a belt 12 and pulleys 13 and 14. A belt 15 is put up at the pulleys 13 and 14.

The driving motor 11, the belt 12, the pulleys 13 and 14, and the belt 15 function so as to provide movement for traveling members 16 and 17 shown in FIG. 4 for scanning in a sub scanning direction perpendicular to a main scanning direction.

The traveling member (also called a first carriage) 16 includes a cylinder shaped lamp 18, a reflector 19, a turning mirror 20, and a semi-permeable type optical element 21. The traveling member (also called a second carriage) 17 includes turning mirrors 22 and 23.

Inside of the housing 10, an image forming lens 25 which forms a part of a scaled-down optical system (image forming optical system) 24 and a one-dimensional image sensor 26 are provided. At an upper part of the housing 10, a contact glass as a manuscript stand 27 is provided. A manuscript 28, having a manuscript surface 28A and a reading part 28B having a line configuration on the manuscript surface 28A, is provided on the upper surface of the contact glass. A light blocking member 10A has a opening part 10B extending in the longitudinal direction of the cylinder shaped lamp 18.

In this embodiment, the cylinder shaped lamp 18 is formed by a Xenon tube. A fluorescent agent is applied to an inside part wall surface 18A of the cylinder shaped lamp 18. An irradiation opening part 18B is formed at the cylinder shaped lamp 18 so as to extend in the direction which the cylinder shaped lamp 18 extends.

In this embodiment, the semi-permeable type optical element 21 is formed by an ND filter having a plane plate configuration and attenuating a lighting light with a constant rate. The semi-permeable type optical element 21 is formed, for example, by forming a metal vapor film on a surface of a glass substrate.

Figure 5:
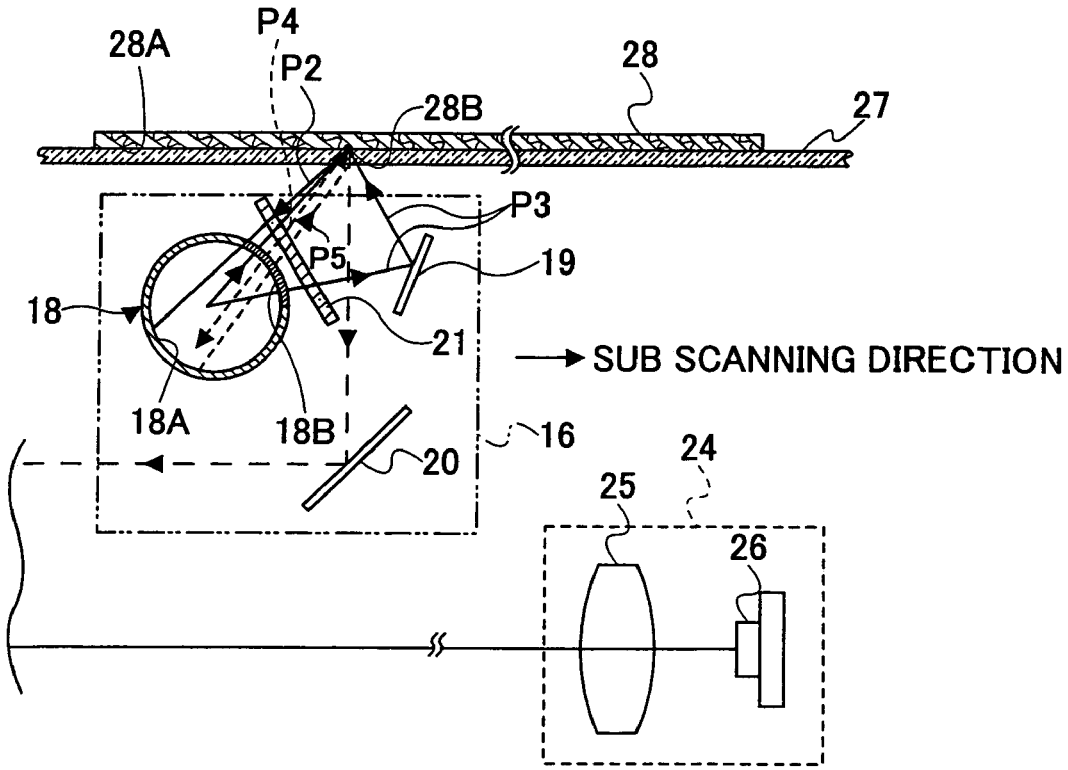
FIG. 5 is an enlarged side surface cross-sectional view of a main part of an optical system of the image reader apparatus of the first embodiment of the present invention

FIG. 5 is an enlarged side surface view of a main part of an optical system of the image reader apparatus of the first embodiment of the present invention. As shown in FIG. 5, the semi-permeable type optical element 21 is provided between the irradiation opening part 18B and the manuscript stand 27 so as to be far from the cylinder shaped lamp 18 and face the irradiation opening part 18B.

The semi-permeable type optical element 21 extends in the direction which the cylinder shaped lamp 18 extends, namely in the direction which the reading part 28B having a line configuration extends, that is the main scanning direction, so as to cover the whole area of the irradiation opening part 18B.

The reflector 19 is provided so as to face the irradiation opening part 18B. The reflector 19 reflects the lighting light from the cylinder shaped lamp 18, so that a reflection lighting light P3 is led from a direction facing a direct lighting light P2, which is directly led from the cylinder shaped lamp 18 to the reading part 28B, to the reading part 28B.

Therefore, the reading part 28B is lighted by the direct lighting light P2 which is irradiated from the irradiation opening part 18B of the cylinder shaped lamp 18 and directly irradiated through the semi-permeable type optical element 21. In addition, the reading part 28B is lighted by a reflection lighting light P3 which is radiated from the irradiation opening part 18B, which is led to the reflector 19 through the semi-permeable type optical element 21, and which is reflected by the reflector 19. That is, the reading part 28B is lighted from both sides of the sub scanning direction by the corresponding lighting lights P2 and P3.

The manuscript surface 28A diffusion-reflects the direct lighting light P2 and the reflection lighting light P3 corresponding to a manuscript density. A part of the diffusion reflection light is reflected in a direction toward the turning mirror 20. The turning mirror 20 reflects the diffusion reflection light toward to the turning mirror 22. The semi-permeable type optical element 21 is provided at a position where the light reflected toward the turning mirror 20 is not shielded.

The turning mirror 22 reflects the diffusion reflection light toward the turning mirror 23. The turning mirror 23 reflects the diffusion reflection light toward the image forming lens 25. An image of the reading part 28B is image formed at the one-dimensional image sensor 26 by the image forming lens 25. The manuscript surface 28A is lighted in the sub scanning direction in order by traveling the cylinder shaped lamp 18 traveling in the sub scanning direction and scanning the manuscript surface 28A. As a result of this, an image that is produced by line sequencing can be read out. Normally, image resolution is 400 through 600 DPI (dots/inch).

According to the first embodiment, the direct lighting light P2 outgoing from the irradiation opening part 18B and the reflection lighting light P3 are attenuated one time by the semi-permeable type optical element 21 and light the reading part 28B and the vicinity thereof. A diffusion light P4, which is a reflection light diffused at the reading part 28B and the vicinity of the reading part 28B and which leads again toward to the irradiation opening part 18B of the cylinder shaped lamp 18, is attenuated again by the semi-permeable type optical element 21 so as to return to an inside part of the cylinder shaped lamp 18 and be reflected at the inside part wall surface 18A of the cylinder shaped lamp 18.

The reflection light reflected at the inside part wall surface 18A is irradiated again from the irradiation opening part 18B so as to be a secondary lighting light P5 which permeates the semi-permeable type optical element 21 and lights the reading part 28B.

According to the first embodiment, the light goes out from the irradiation opening part 18B, leads toward to the reading part 28B, is diffusion-reflected at the reading part 28B, and returns to the inside part of the cylinder shaped lamp 18. The light goes through the semi-permeable type optical element 21 when the light is reflected at the inside part wall surface 18A, goes out from the irradiation opening part 18B, and leads again toward to the reading part 28B. Therefore, the light which is a primary light for the secondary lighting light P5 is attenuated three times.

Assuming that the permeability rate of the semi-permeable type optical element 21 is set as X[%], the lighting lights (primary lighting lights) P2 and P3 at the reading part 28B have strengths K1 when the semi-permeable type optical element 21 is not provided, and the secondary lighting light P5 at the reading part 28B has strength K2 when the semi-permeable type optical element 21 is not provided, a simple calculation, without considering the reflection rate at the inside part wall surface 18A, is performed, so that the strength at the reading part 28B of the primary lighting light P2 when the semi-permeable type optical element 21 is provided is calculated as (K1×X)/100 and the strength at the reading part 28B of the secondary lighting light P5 is calculated as (K2×X3)/100. For example, if X equals 70[%], the primary lighting light P2 is attenuated by 30[%] and the secondary lighting light P5 is attenuated by 65.7[%]. Therefore, it is possible to reduce the contribution rate at the reading part 28B of the secondary lighting light P5.

Therefore, the change of the light amount, based on the change of the manuscript density, of the sum total lighting light (P2+P5) at the reading part 28B of the primary lighting light P2 and the secondary lighting light P5 can be made small.

Although it may be possible to relatively reduce the contribution rate at the reading part 28B of the secondary lighting light P5 as the permeability rate of the semi-permeable type optical element 21 is made lower, the light amount required for reading the image of the manuscript 28 is also reduced so that the S/N ratio is bad and noise is increased. Hence, the permeability rate of the semi-permeable type optical element 21 is decided based on consideration of the light amount required for reading the image of the manuscript and change of the manuscript density, and of the total sum of lighting light of the primary lighting lights P2 and P3 and the secondary lighting light P5.

Figure 6:
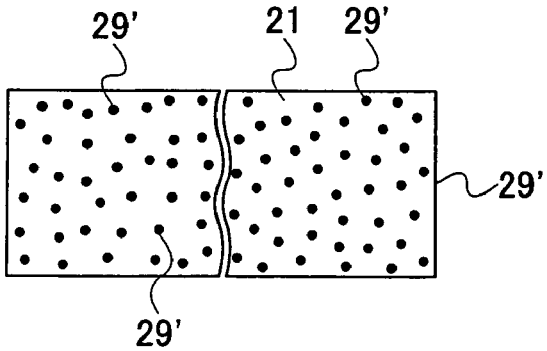
FIG. 6 is a plan view roughly showing a modification example of a semi-permeable type optical element of the first embodiment.

FIG. 6 is a plan view roughly showing a modification example of the semi-permeable type optical element 21 of the first embodiment. In the first embodiment, the semi-permeable type optical element 21 is formed by forming a metal vapor film on the surface of the glass substrate. As shown in FIG. 6, it is possible to implement a light-absorbing process by forming small black net points 29' on the surface of the glass substrate randomly so that the diffusion reflection light at the reading part 28B is minimally reflected at the surface of the semi-permeable type optical element 21.

According to the above-mentioned modification example, it is possible to avoid the diffusion reflection light which is diffusion-reflected at the reading part 28B from becoming the secondary lighting light P5 which lights again the reading part 28B by a mirror surface reflection based on the metal vapor film of the semi-permeable type optical element 21.

It is preferable for the small black net points 29' to be provided at the surface of the side facing the manuscript stand 27 so that increasing of the temperature of the semi-permeable type optical element 21 based on absorption of the light can be prevented.

Second Embodiment

In the above-described first embodiment, the semi-permeable type optical element 21 has a plane plate configuration, and the cylinder shaped lamp 18 is provided so as to be separated from and face toward the semi-permeable type optical element 21.

However, the cylinder shaped lamp 18 generates heat due to emission of light. Also, heat is stored at the semi-permeable type optical element 21 because the semi-permeable type optical element 21 absorbs more light as the permeability rate becomes smaller. Hence, there may be disadvantages in that as the temperature of optical parts forming a lighting optical system rises, the optical parts thermally expand so that the position precisions become worse; the optical parts are modified, and the surface precision of the optical parts becomes worse; and the like.

Therefore, there is a possible idea that separation distance between the cylinder shaped lamp 18 and the semi-permeable type optical element 21 be sufficiently provided so that a cooling effect on the cylinder shaped lamp 18 and the semi-permeable type optical element 21 is improved by providing an air current between the cylinder shaped lamp 18 and the semi-permeable type optical element 21.

However, as the separation distance between the cylinder shaped lamp 18 and the semi-permeable type optical element 21 becomes longer, the lighting optical system is made large so that it is difficult to make the lighting optical system compact. Furthermore, the distance between the cylinder shaped lamp 18 and the manuscript surface 28A is longer so that the light amount of the lighting light reaching the manuscript surface 28A is reduced and consumption of electric power and the cost are high.

Figure 7:
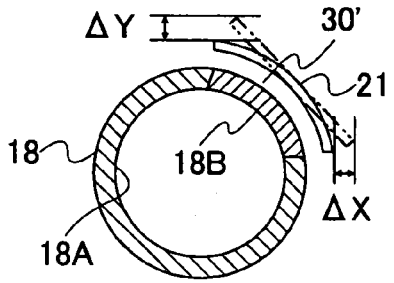
FIG. 7 is a cross-sectional view showing a cross-sectional configuration of a semi-permeable type optical element of a second embodiment.

Accordingly, in the second embodiment, as shown in FIG. 7, the cross-sectional configuration of the semi-permeable type optical element 21 is made suitable for the curved surface of the tube wall of the cylinder shaped lamp 18, and a sufficient air current path 30' is provided between the cylinder shaped lamp 18 and the semi-permeable type optical element 21. Here, FIG. 7 is a cross-sectional view showing a cross-sectional configuration of a semi-permeable type optical element of the second embodiment.

As a result of this, heat radiation from the semi-permeable type optical element 21, which is a possible new heat source, is promoted so that cooling efficiency can be improved.

In the second embodiment, the semi-permeable type optical element 21 is also curved, with the same center of curvature and following the curvature of the cylinder shaped lamp 18. Hence, it is possible to implement a compact layout in the vertical direction by $\Delta Y$ and in the horizontal direction by $\Delta X$ as compared with the semi-permeable type optical element 21 having a plane plate configuration shown by a dotted line in FIG. 7. Because of this, it is possible to cope with conflicting objectives which are making the lighting optical system compact and improvement of cooling efficiency of the semi-permeable type optical element 21.

Third Embodiment

Figure 8:
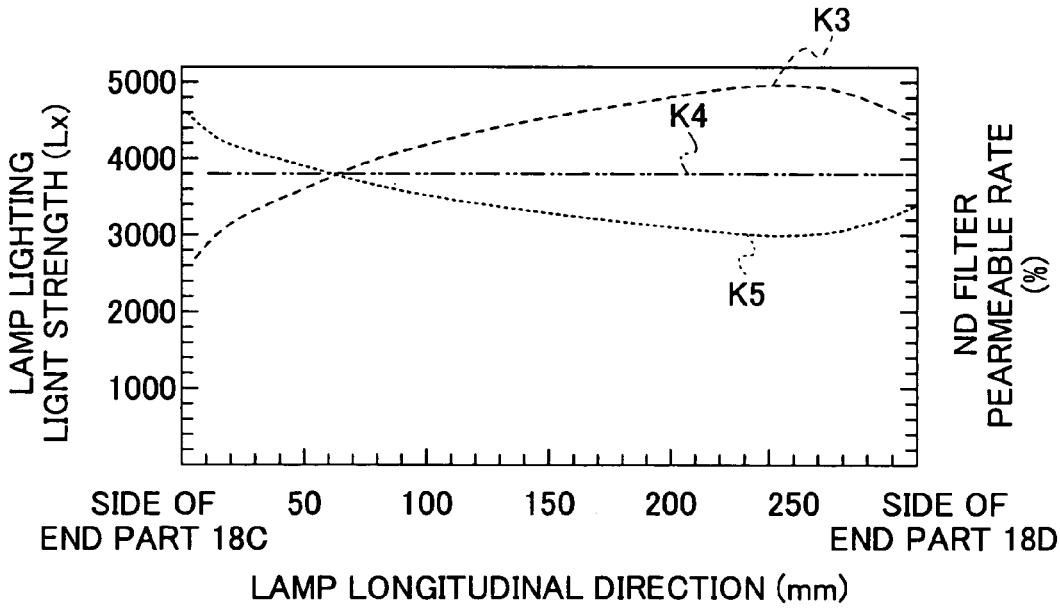
FIG. 8 is a graph for explaining a relationship between a permeability rate property of a semi-permeable type optical element of a third embodiment and an emission light strength distribution of a cylinder shaped lamp.

It is preferable that the strength of the lighting light P2 along the longitudinal direction of the cylinder shaped lamp 18 be uniform, that is, for the emission light strength distribution to be uniform. However, as a matter of fact, as shown in FIG. 8, the strength of the lighting light P2 along the longitudinal direction of the cylinder shaped lamp 18 is non-uniform, and there is unevenness of the strength of the lighting light P2 along the longitudinal direction of the cylinder shaped lamp 18. Here, FIG. 8 is a graph for explaining a relationship between a permeability rate property of a semi-permeable type optical element of the third embodiment and a emission light strength distribution of a cylinder shaped lamp.

For example, the strength of the lighting light P2 at a side of one end part 18D is larger than the strength of the lighting light P2 at a side of the other end part 18C of the cylinder shaped lamp 18. The cylinder shaped lamp 18 has a emission light strength distribution shown by a mark "K3" in FIG. 8. Hence, the image quality after image reading may be worse due to unevenness of the emission strength distribution K3.

Because of this, the permeability rate distribution property K5 of the semi-permeable type optical element 21 is given as shown in FIG. 8 so that the emission light strength distribution K4 of the lighting light P2 leading from the end part side 18C to the other end part side 18D when the lighting light P2 passes through the semi-permeable type optical element 21 is uniform at the manuscript surface 28A.

Because of this structure, it is possible to make the light amount distribution in the longitudinal direction of the cylinder shaped lamp 18 of the lighting lights P2 and P3 uniform after the permeation by the semi-permeable type optical element 21.

Fourth Embodiment

Comparing the direct lighting light P2 which directly leads from the cylinder shaped lamp 18 to the reading part 28B and the lighting light P3 which is reflected by the reflector 19 and leads from a direction opposite to the direct lighting light P2 to the reading part 28B, the lighting light P3 which leads to the reading part 28B through the reflector 19 has a longer path. Since there is diffusion by the reflector 19, the strength of the lighting light P3 which leads to the reading part 28B through the reflector 19 is smaller than the strength of the direct lighting light P2 which leads to the reading part 28B.

The diffusion light which is diffused at the reading part 28B and returns to the irradiation opening part 18B of the cylinder shaped lamp 18 through the reflector 19 is smaller than the diffusion light which is diffused at the reading part 28B and directly returns to the irradiation opening part 18B.

On the other hand, it is ideal in terms of obtaining a high quality reading image that the strength of the direct lighting light P2 which directly leads from the cylinder shaped lamp 18 to the reading part 28B be the same as the strength of the lighting light P3 which is reflected by the reflector 19 and leads from a direction opposite to the direct lighting light P2 to the reading part 28B. For example, there is an advantage that shade at the step part not be generated at even a manuscript part having a step.

Figure 9:
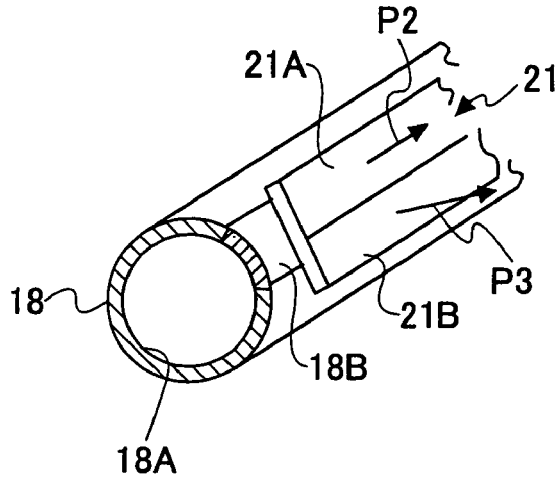
FIG. 9 is a perspective view for explaining a structure of a semi-permeable type optical element of a fourth embodiment.

Accordingly, in the fourth embodiment, as shown in FIG. 9, a permeable area 21A and a permeable area 21B are provided in the semi-permeable type optical element 21. The direct lighting light P2 which directly leads from the cylinder shaped lamp 18 to the reading part 28B is permeated in the permeable area 21A. The lighting light P3 which leads to the reflector 19 is permeated in the permeable area 21B. The permeability rate of the permeable area 21B is larger than the permeability rate of the permeable area 21A.

Thus, it is possible to adjust the ratio of the strengths of the direct lighting light P2 which directly leads to the reading part 28B and the lighting light P3 which leads from a direction opposite to the direct lighting light P2 to the reading part 28B, so that it is possible to achieve improved development of the image quality.

Although the permeable area is divided into two steps in this fourth embodiment, it may be divided into three and more steps. Furthermore, the permeable area of the semi-permeable type optical element 21 may have a structure where the permeability rate of the lighting light is progressively (consecutively) larger from the area in which the direct lighting light P2 which directly leads from the cylinder shaped lamp 18 to the reading part 28B is permeated to the area in which the lighting light P3 which leads to the reflector 19 is permeated.

Fifth Embodiment

Figure 10:
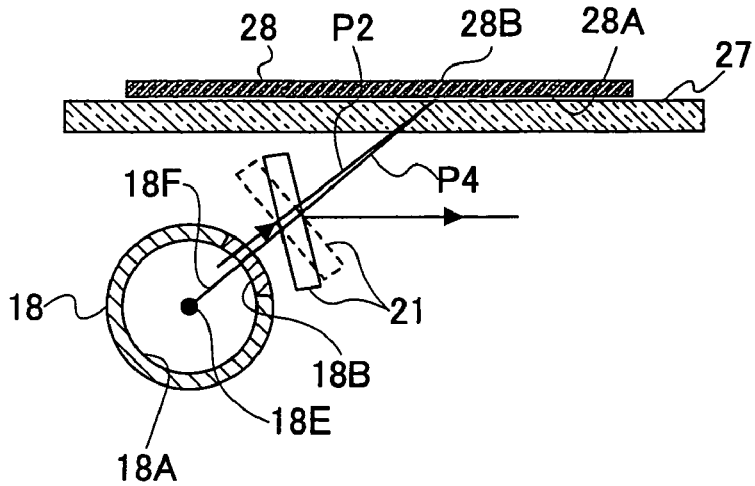
FIG. 10 is a cross-sectional view for explaining an image reader apparatus of a fifth embodiment of the present invention.

As shown in FIG. 10 by a dotted line, in a case where the semi-permeable type optical element 21 is provided perpendicularly to a segment 18F by which a center axis 18E of the cylinder shaped lamp 18 and the reading part 28B are perpendicularly connected, the direct lighting light P2 irradiated from the irradiation opening part 18B can be permeated efficiently. As a result of this, it is possible to make the size of the semi-permeable type optical element 21 small.

However, in the case where the semi-permeable type optical element 21 is provided perpendicularly to the segment 18F by which the center axis 18E of the cylinder shaped lamp 18 and the reading part 28B are connected, the light which is diffusion-reflected at the reading part 28B and leads to the semi-permeable type optical element 21 is reflected at a surface or a back surface of the semi-permeable type optical element 21 so as to be a secondary lighting light which returns again to the reading part 28B.

In this case, although it is an idea that an absorption process such that a light reflection prevention film be formed on a surface of the optical element 21, it is complicated to manufacture such a semi-permeable type optical element 21. In addition, it is impossible to optically and ideally make the reflections at a surface and a back surface of the semi-permeable type optical element 21 zero.

Hence, as shown in FIG. 10 by a solid line, even if the semi-permeable type optical element 21 is provided so as to be tilted against the segment 18F by which the center axis 18E of the cylinder shaped lamp 18 and the reading part 28B are perpendicularly connected and the diffusion light P4 reflected by the reading part 28B returns to the semi-permeable type optical element 21 and is reflected, the light is prevented from being reflected in a direction far from the reading part 28B and being the secondary lighting light.

Sixth Embodiment

In the above-described fifth embodiment, the light which is diffusion-reflected at the reading part 28B and returns to the semi-permeable type optical element 21 is reflected in a direction far from the reading part 28B. However, in the actual lighting optical system, there may be another reflector and the optical source may be in the direction in which the light diffusion reflected at the reading part 28B and returning the semi-permeable type optical element 21 is let go. If the above-mentioned reflector and the light source are so located, the light reflected by the reflector or the light from the light source may reach the reading part 28B so that image reading quality may be worse.

Furthermore, depending on an arranging position of the cylinder shaped lamp 18 and a position (angle) against a horizontal surface of the irradiation opening part 18B, a tilt angle of the optical element 21 where the generation of the flare phenomenon is properly controlled is changed. Hence, it is preferable to adjust the tilt position of the semi-permeable type optical element 21 based on the consideration of an influence due to unevenness of the arranging position of the optical parts.

Figure 11:
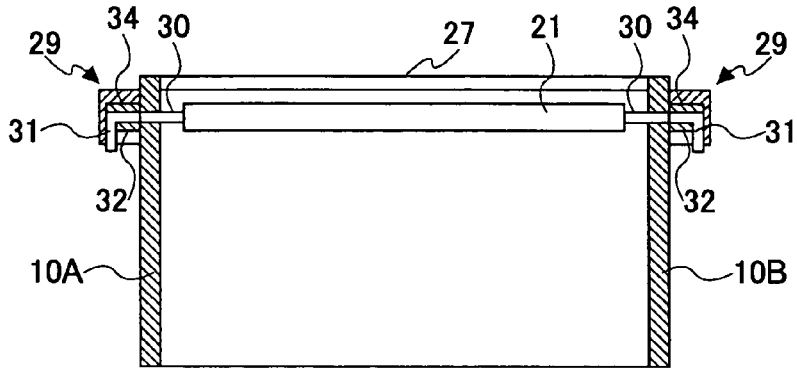
FIG. 11 is a cross-sectional view showing a rough structure of an image reader apparatus of a sixth embodiment of the present invention.
Figure 12:
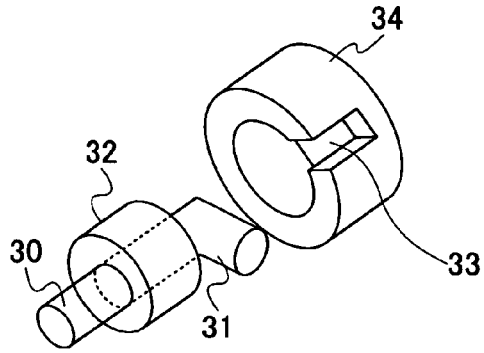
FIG. 12 is a perspective view roughly showing a main structure of a revolving mechanism shown in FIG. 11.

Because of this, in this sixth embodiment a revolving mechanism 29 is provided at the side walls 10A and 10B of the housing 10 as shown in FIG. 11. The semi-permeable type optical element 21 is supported by a pair of horizontal revolving shafts 30 which form a part of the revolving mechanism 29. Lever members 31 are formed at the pair of horizontal revolving shafts 30 as shown in FIG. 12. Support pipes 32 which form a part of the revolving mechanism 29 are fixed to the side walls 10A and 10B. The horizontal revolving shafts 30 are rotatably supported by the support pipes 32.

After the optical parts are arranged in the housing 10, the tilt of the semi-permeable type optical element 21 is adjusted and the light amount at the reading part 28B is measured at the tilt position of the semi-permeable type optical element 21 by a line sensor, for example, so that the tilt angle (tilt position) of the semi-permeable type optical element 21 is set where the amount of the lighting light is minimum.

After the position against the cylinder shaped lamp 18 of the semi-permeable type optical element 21 is adjusted, engaging grooves 33 of the fixing pipes 34 are interfit to the support pipes 32, so that the position is stably fix-supported.

Because of this, it can be minimum that the light reflected at the semi-permeable type optical element 21 that becomes the secondary lighting light and returns to the reading part 28B can be minimized, so that the generation of the flare phenomenon can be further reduced.

According to the sixth embodiment, the position of the semi-permeable type optical element 21 can be adjusted without limiting steps. However, after the tilt of the semi-permeable type optical element 21 is adjusted, the horizontal revolving shafts 30 may be fixed to the side walls 10A and 10B of the housing 10 by screws.

Seventh Embodiment

Figure 13:
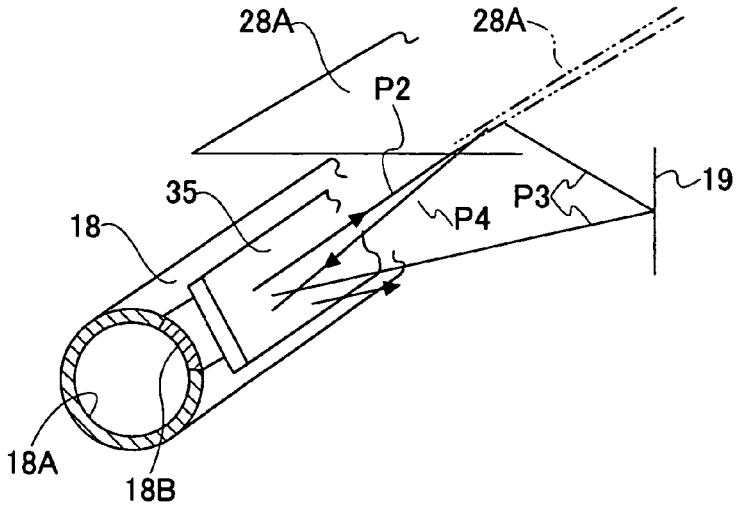
FIG. 13 is a perspective view roughly showing an optical element of a seventh embodiment of the present invention and the cylinder shaped lamp.

In the above-described first through sixth embodiments, the semi-permeable type optical element 21 is formed by an ND filter. Instead of the semi-permeable type optical element 21, as shown in FIG. 13, a polarization filter 35 may be used as the optical element. The polarization filter 35 allows a light having a polarization component in a specific direction to pass through.

As schematically shown in FIG. 13, among lights outgoing through the irradiation opening part 18B of the cylinder shaped lamp 18, the light having a specific polarization angle becomes the lighting lights P2 and P3 so as to irradiate. The lighting lights P2 and P3 having the specific polarization angles are absorbed corresponding to the manuscript density at the reading part 28B. Remaining lights are diffusion-reflected and the diffusion light P4 of a part of the lights returns to the polarization filter 35.

The diffusion light P4 which is reflected at the reading part 28B and returns to the polarization filter 35 does not pass through the polarization filter 35, because the polarization angle is changed at the time of reflection at the reading part 28B. Hence, the above-mentioned diffusion light P4 is absorbed by the polarization filter 35. Therefore, the light diffusion reflected at the reading part 28B does not return to the inside part of the cylinder shaped lamp 18 through the irradiation opening part 18B. As a result of this, the generation of the secondary lighting light can be controlled.

Eighth Embodiment

There is an image reader apparatus by which a full color image can be read. In order to read the color of the manuscript surface 28A precisely, it is required that the color of the lighting light irradiated from the irradiation opening part 18B of the cylinder shaped lamp 18 be a white color.

In a case where the lighting light excludes a specific color component or the strength of the lighting light is weak, the resolving power of the color of the manuscript corresponding to the affected color is reduced. It is not easy to obtain a perfect white color light in the cases where the cylinder shaped lamp 18 is an Xenon lamp and a fluorescent lamp. If a plurality of colors of fluorescent paints are applied so as to obtain the white color lighting light, the cost increases.

Because of this, in the eighth embodiment, a color of the semi-permeable type optical element 21 having a supplemental relationship with the emission light of the cylinder shaped lamp 18 is selected. In addition, a relatively strong color component in the emission light of the cylinder shaped lamp 18 is absorbed so as to have the substantially same strength as the remaining color components. As a result of this, the lighting light that passes through the semi-permeable type optical element 21 becomes a white color light.

Furthermore, the cylinder shaped lamp 18 may emit a light from the visible range to the infrared range. The image sensor 26 also has a photographic sensitivity to a wave length in not only the visible range but also the infrared range. However, there is almost no infrared range in the photographic sensitivity of humans. Furthermore, the light having a wave length in the infrared range is not necessary for reading the image. If the light having the wave length in the infrared range is incident on the image sensor 26, the image quality may become worse. Conventionally, an infrared light cut filter for cutting the light having the wave length in the infrared range is provided just in front of the image forming lens 25 which forms the scaled-down optical system 24. According to the eighth embodiment, it is possible to reduce the cost and make the apparatus compact by giving a permeability rate property for cutting the light having the wave length in the infrared range to the semi-permeable type optical element 21.

Ninth Embodiment

Figure 14:
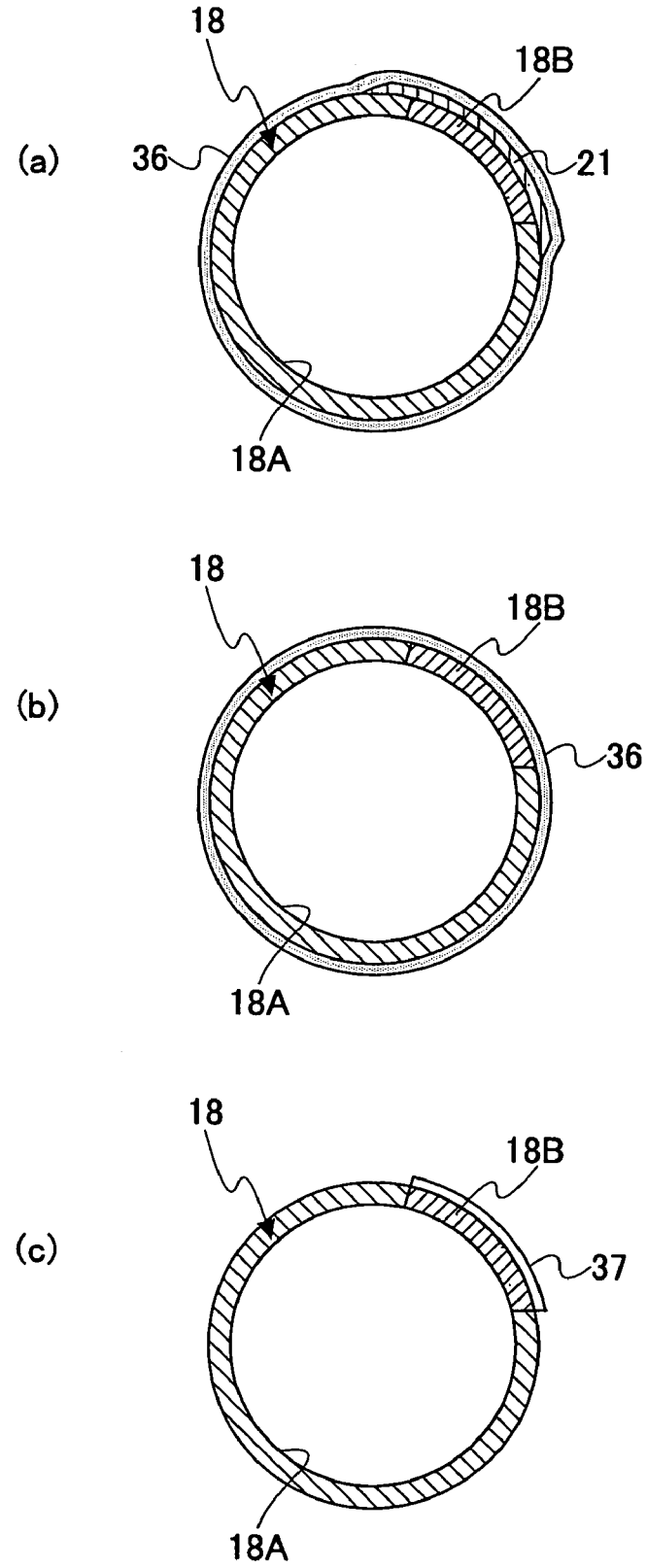
FIG. 14 shows various states of the cylinder shaped lamp of a ninth embodiment of the present invention; more specifically, FIG. 14-(*a*) is a cross-sectional view showing a state where the semi-permeable type optical element is provided between a protection tube and a pipe wall, FIG. 14-(*b*) is a cross-sectional view showing a state where a protection tube having the same optical function as an optical function of the semi-permeable type optical element is provided at the tube wall, and FIG. 14-(*c*) is a cross-sectional view showing a state of the cylinder shaped lamp where an attenuation film is provided at the irradiation opening part.

Although, in the first through eighth embodiments, the semi-permeable type optical element 21 is provided independently from the cylinder shaped lamp 18, in the ninth embodiment a permeable protection tube 36 protects a tube wall of the cylinder shaped lamp 18 at the cylinder shaped lamp 18 so that the semi-permeable type optical element 21 is put and fixed between the tube wall and the permeable protection tube 36, as shown in FIG. 14-(*a*).

Because of this structure, it is possible to make the light source part comprising the semi-permeable type optical element 21 and the cylinder shaped lamp 18 compact.

Furthermore, as shown in FIG. 14-(*b*), the permeable protection tube 36 may have a property by which the optical function of the semi-permeable type optical element 21 can be performed. In addition, as shown in FIG. 14-(*c*), an attenuation film 37 may be provided so that the reflection light which is reflected at the reading part 28B and incident on the inside part of the cylinder shaped lamp 18 through the irradiation opening part 18B, and then reflected by the inside part wall surface 18A and led to the reading part 28B through the irradiation opening part 18B, can be attenuated.

Figure 15:
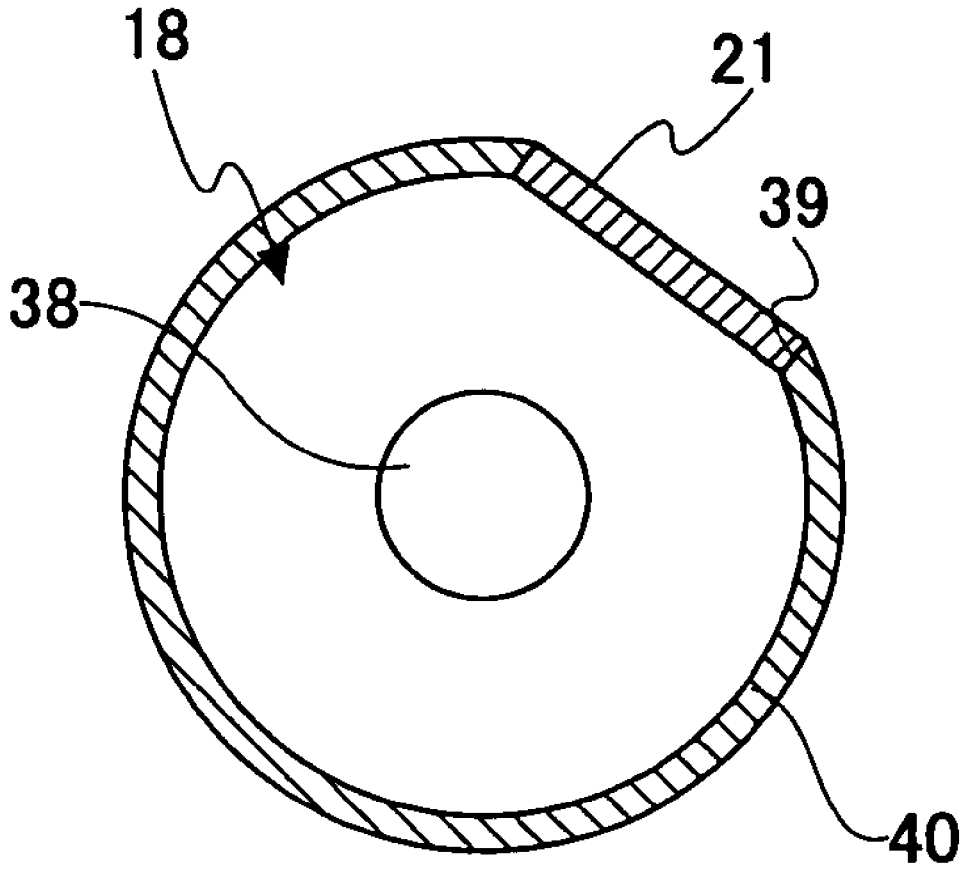
FIG. 15 is a cross-sectional view showing a state where a light source part includes a halogen lamp and a concave surface reflection mirror having the irradiation opening part and where the semi-permeable type optical element is provided at the irradiation opening part.

Although, in the above-described first through ninth embodiments, an Xenon tube is used as the cylinder shaped lamp 18 and the light source part is formed by the Xenon tube and the semi-permeable type optical element 21, the light source part may be formed by a halogen lamp 38 and a concave surface reflection mirror 40 having the irradiation opening part 39, and the semi-permeable type optical element 21 may be provided at the irradiation opening part 39, as shown in FIG. 15.

Tenth Embodiment

Figure 16:
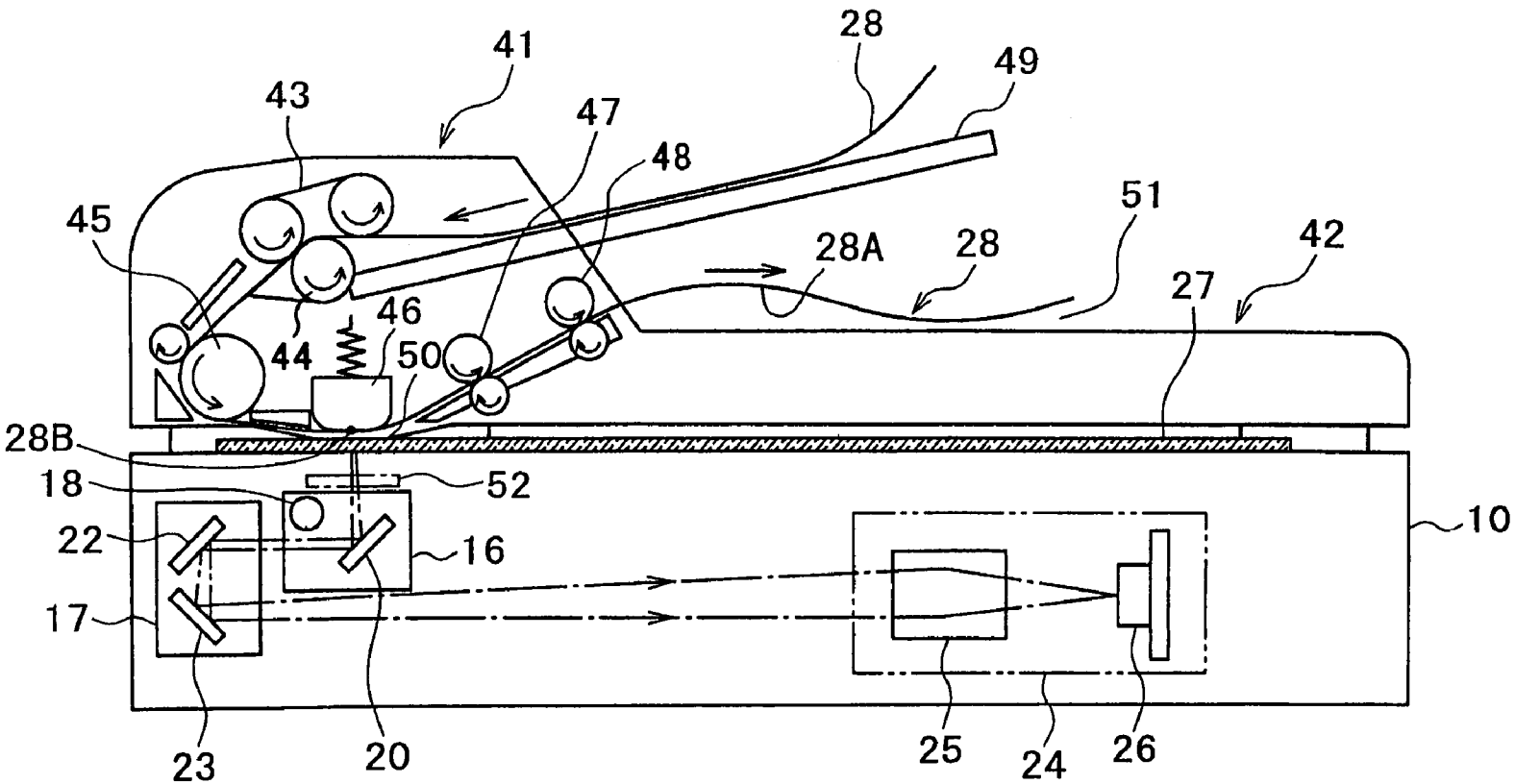
FIG. 16 is a cross-sectional view showing a rough structure of an image reader apparatus of a tenth embodiment of the present invention.
Figure 17:
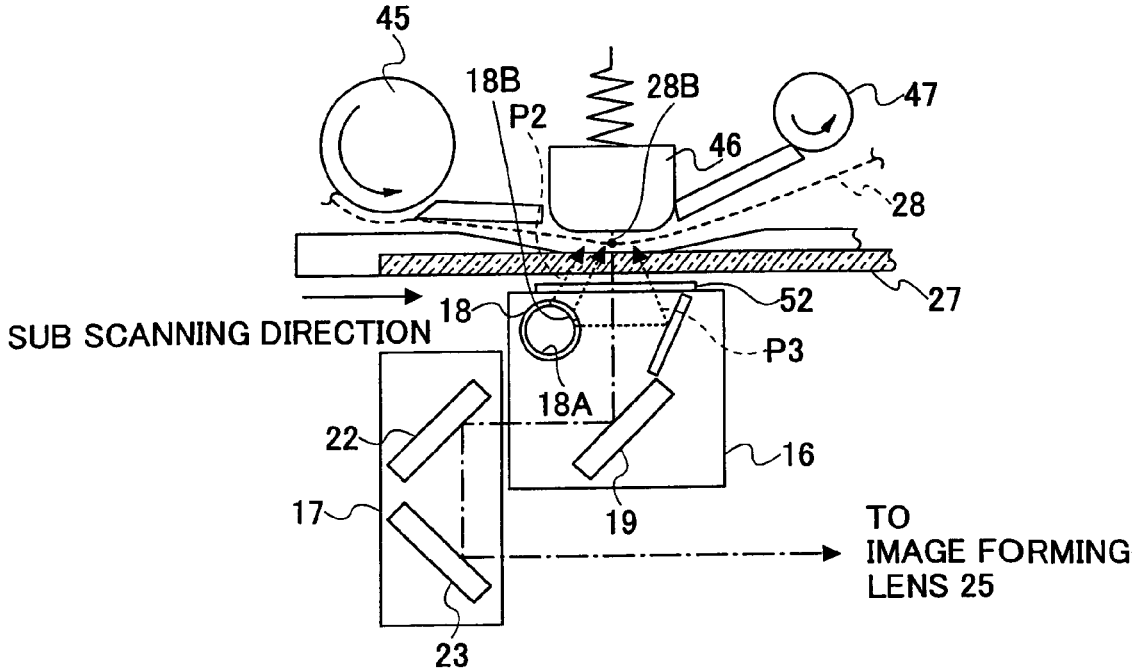
FIG. 17 is a partially enlarged cross-sectional view of the image reader apparatus shown in FIG. 16.

Referring to FIG. 16 and FIG. 17, an image reader apparatus where a sheet document feeder is provided to the manuscript stand will be described. In FIG. 16 and FIG. 17, parts that are the same as the parts shown in FIG. 4 are given the same reference numerals, and explanation thereof is omitted.

The sheet document feeder 41 includes a feeder main body 42. A paper feeder belt 43, a separation roller 44, a pull out roller 45, a pressurizing pad 46, an intermediate roller 47, and a discharge roller 48 are provided inside of the feeder main body 42.

A manuscript paper feeder 49 is provided at the feeder main body 42. A plurality of pieces of manuscript 28 is provided at the manuscript paper feeder 49. An opening part 50 extending in a direction which the cylinder shaped lamp 18 extends is formed at a lower part of the feeder main body 42. The pressurizing pad 46 pushes the reading part 28B of the manuscript 28 to a contact glass 27' as the manuscript stand 27, via the opening part 50.

The manuscripts 28 are separated into a top surface paper and remaining papers by the separation roller 44. The manuscript 28 is led to the inside of the feeder main body 42 by the paper feeder belt 43, and has its direction of movement changed by the pull out roller 45 so as to face the pressuring pad 46. After passing through the opening part 50, the manuscript 28 is discharged to the paper discharge part 51 via the intermediate roller 47 and the paper discharge roller 48.

In a case where the sheet document feeder 41 is used, traveling members 16 and 17 are fixed to the housing 10. Because of this, the manuscripts 28 are fed consecutively so that the images of the manuscripts 28 can be read.

Figure 18:
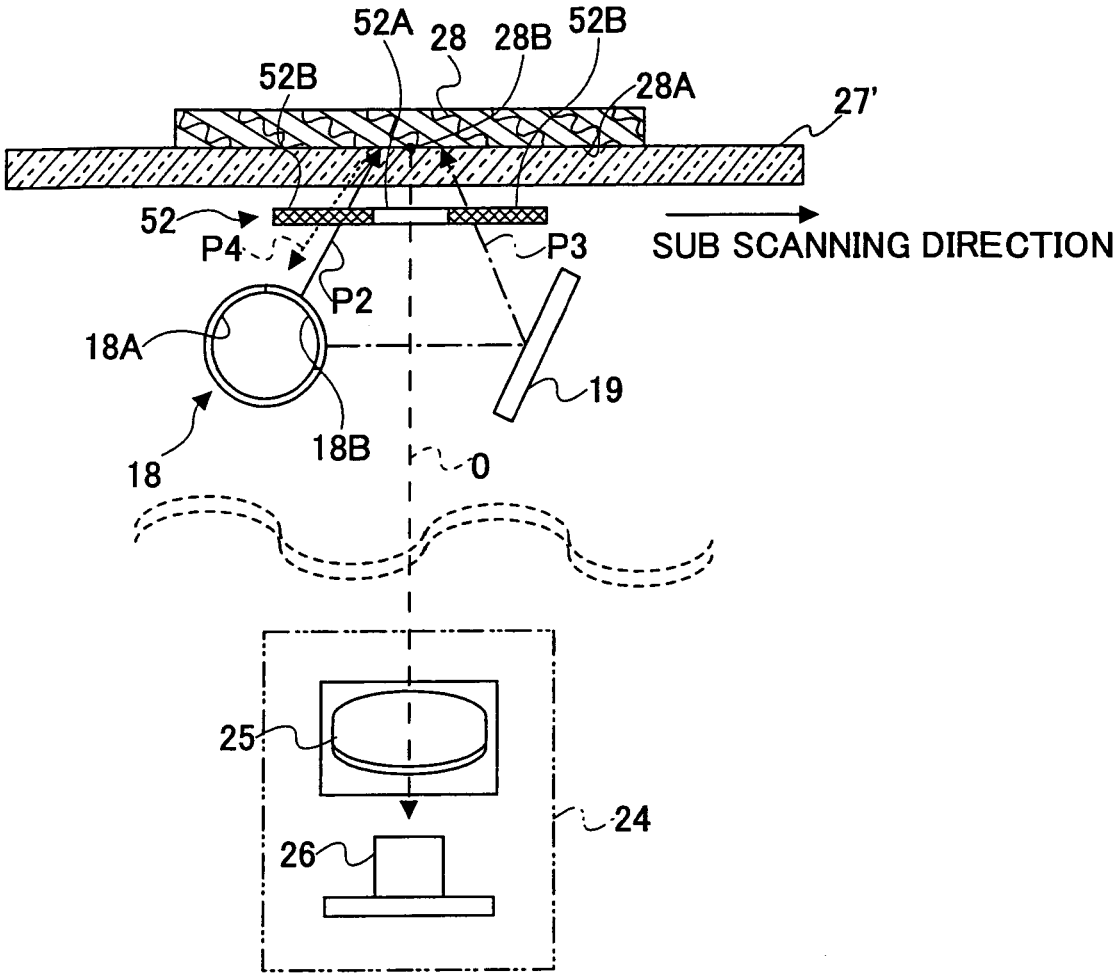
FIG. 18 is a schematic diagram showing a main structure of an optical system of the image reader apparatus shown in FIG. 17.

In the tenth embodiment, as enlargedly shown in FIG. 18, an optical element 52 is provided at the traveling member 16. Here, the cylinder shaped lamp 18 shown in FIG. 5 is provided as the light source part. The optical element 52 has a whole permeable area 52A and semi-permeable area 52B. The whole permeable area 52A faces the reading part 28B from a direction of a light axis O of the image forming optical system against the contact glass 27'. The semi-permeable area 52B is provided between the manuscript surface 28A and the cylinder shaped lamp 18, so that the lighting light P2 from the irradiation opening part 18B of the cylinder shaped lamp 18 is attenuated and permeated before reaching the manuscript surface 28A. An ND filter is used as the optical element 52. The whole permeable area 52A and the semi-permeable area 52B extend in the direction in which the cylinder shaped lamp 18 extends.

The primary lighting light P2 injected from the irradiation opening part 18B leads to the manuscript surface 28A via one of the semi-permeable areas 52B. The reflection lighting light P3 reflected by the reflector 19 leads to the manuscript surface 28A via the other of the semi-permeable areas 52B. As a result of this, the manuscript surface 28A is lighted in a line state.

A part of the reflection light from the reading part 28B of the manuscript surface 28A lighted in a line state permeates to the whole permeable area 52A facing the reading part 28B, so as to be image-formed at the image sensor 26 by the image forming lens 25 of the image forming optical system.

Figure 19:
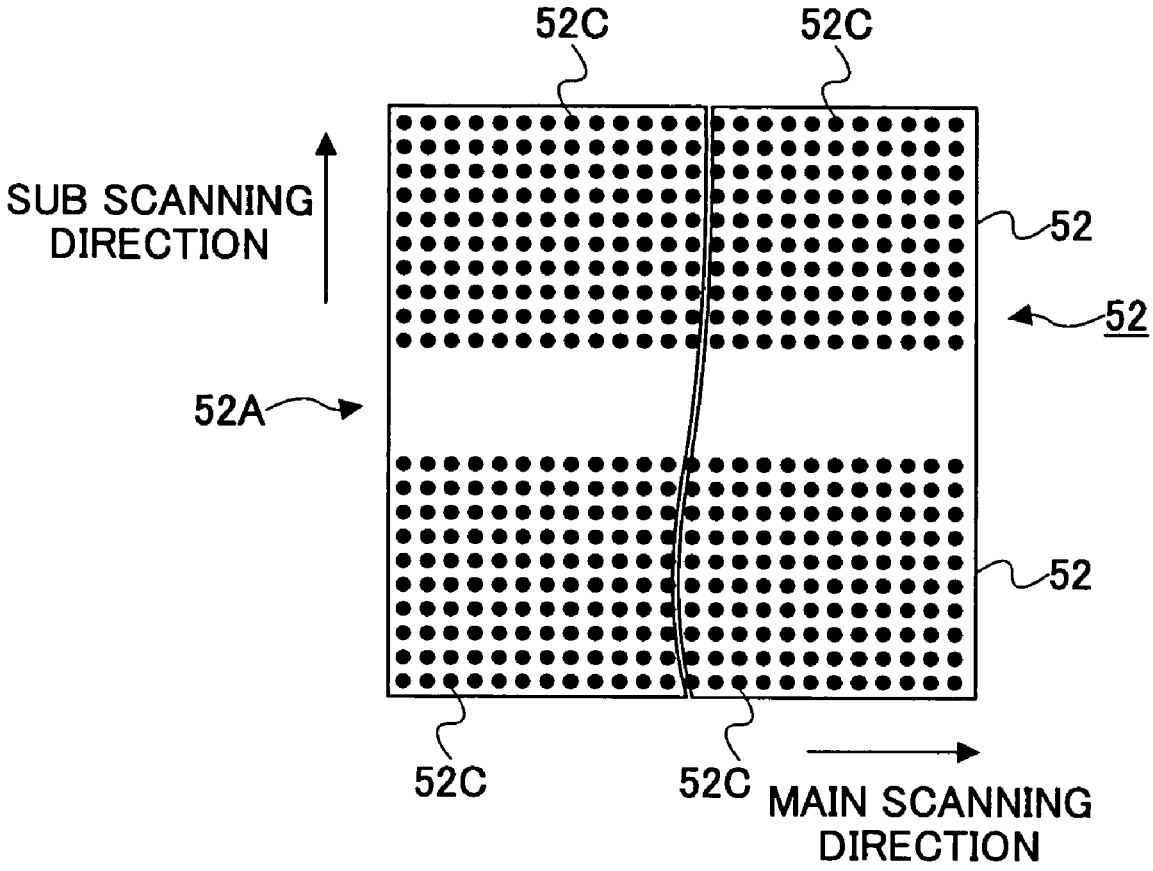
FIG. 19 is a plan view showing an example of an optical element shown in FIG. 18.

The semi-permeable areas 52B are provided at both sides of the whole permeable area 52A so that the whole permeable area 52A is put between the semi-permeable areas 52B. Here, as shown in FIG. 19, the semi-permeable area 52B is formed by small black net points 52C having substantially same sizes and arranged uniformly.

In a case where the semi-permeable area 52B is formed by metal vaporization, the surface of the semi-permeable area 52B becomes a mirror surface state. As a result of this, the probability that a light is reflected so as to become the secondary lighting light increases, so that the probability that a reduction of the secondary lighting light, which is a primary purpose, will not be achieved may increase. However, if the optical element 52 shown in FIG. 19 is used, almost all of lighting lights reflected in a case where a mirror surface process is applied are absorbed as heat energy by the black net points 52C. As a result of this, it is possible to make the surface of the optical element 52 glossy and the reflection at the surface small.

According to the tenth embodiment, the light goes out from the irradiation opening part 18B, leads toward the reading part 28B, is diffusion-reflected at the reading part 28B, and returns the inside part of the cylinder shaped lamp 18 as the diffusion light P4. The diffusion light P4 goes through the semi-permeable area 52B of the optical element 52 when reflected at the inside part wall surface 18A, goes out from the irradiation opening part 18B, and leads again toward the reading part 28B. Therefore, the light that is a primary light for the secondary lighting light P5 is attenuated three times.

Assuming that the permeability rate of the optical element 52 is set as X[%], the lighting lights (primary lighting lights) P2 and P3 at the reading part 28B has strength, K1 when the optical element 52 is not provided, and the secondary lighting light P5 at the reading part 28B have strengths K2 when the optical element 52 is not provided, a simple calculation without considering the reflection rate at the inside part wall surface 18A is implemented, so that the strength at the reading part 28B of the primary lighting light P2 when the optical element 52 is provided is calculated as (K1×X)/100 and the strength at the reading part 28B of the secondary lighting light P5 is calculated as (K2×X3)/100. For example, if X equals 70[%], the primary lighting light P2 is attenuated by 30[%] and the secondary lighting light P5 is attenuated by 65.7[%]. Therefore, it is possible to reduce the contribution rate at the reading part 28B of the secondary lighting light P5.

Therefore, the change of the light amount based on the change of the manuscript density of the sum total lighting light (P2+P5) at the reading part 28B of the primary lighting light P2 and the secondary lighting light P5 can be made small, as described above in the explanation of the first embodiment.

Although it may be possible to relatively reduce the contribution rate at the reading part 28B of the secondary lighting light P5 as the permeability rate of the optical element 52 is lower, the light amount required for reading the image of the manuscript 28 is also reduced so that the S/N ratio is bad and noise is increased. Hence, the permeability rate of the optical element 21 is decided based on consideration of the light amount required for reading the image of the manuscript and change of the manuscript density, which light amount is the total sum lighting light of the primary lighting lights P2 and P3 and the secondary lighting light P5.

The width of the whole permeable area 52A in the sub scanning direction is determined by the effective diameter of the image forming lens 25 and the focus distance to the manuscript surface 28A. Assuming that the effective diameter of the image forming lens 29 is ϕ the focus distance is L1, and the distance between the image forming lens 29 and the optical element 52 is L2, the width W of the whole permeable area 52A in a sub scanning direction is satisfied with a formula of W=ϕ×L2/L1 as an ideal. However, as a matter of fact, three times of the above-mentioned width W is necessary because there are errors in the image forming lens 25 of the image reader apparatus, the arranging position error of the image sensor 26, and others.

Therefore, according to the tenth embodiment, as well as the first embodiment, it is possible to prevent the flare generated due to the reflection light from the manuscript surface 28A of the lighting light being re-reflected inside the cylinder shaped lamp 18 so as to light the manuscript surface 28A again, namely, the change of reading density at the interface part of the manuscript density such as the change of reading density at the interface part of a letter manuscript.

Furthermore, as described in the third embodiment, if the permeability rate of the semi-permeable area 52B of the optical element 52 is set corresponding to the emission light strength distribution in the direction which the cylinder shaped lamp 18 extends, it is possible to achieve a uniform amount of the lighting light on a manuscript in the direction which the cylinder shaped lamp 28 extends, so that it is possible to obtain an image having a higher quality. For example, the permeability rate of the semi-permeable area 52B of the optical element 52 is set small at a position where the emission light strength distribution is high, and the permeability rate of the semi-permeable area 52B of the optical element 52 is set large at a position where the emission light strength distribution is low.

In addition, as described in the eighth embodiment, in a case where the optical element 52 has a color having a supplemental color relationship with a color of the emission of light of the cylinder shaped lamp 18, the lighting light which lights the manuscript surface has a white color. In a case of a full color image reader apparatus, it is possible to obtain an image having a higher quality.

Eleventh Embodiment

Figure 20:
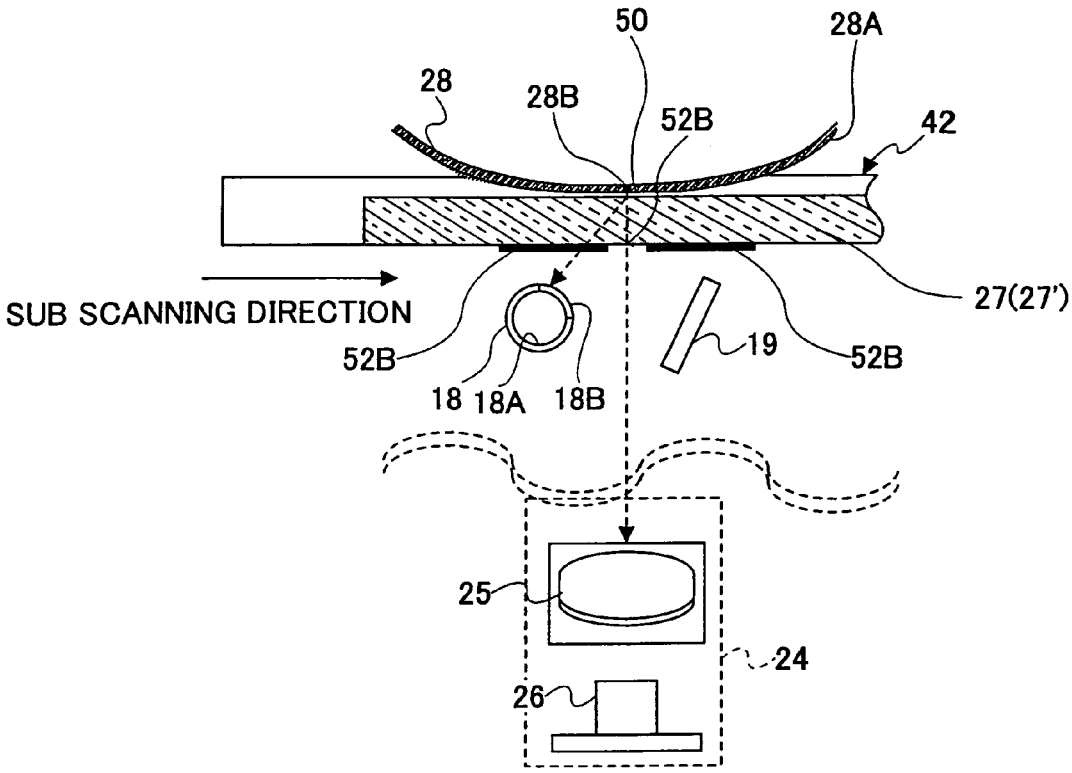
FIG. 20 is a schematic diagram showing a main part structure of an optical system of an image reader apparatus of an eleventh embodiment of the present invention and a state where a semi-permeable area is formed at a contact glass.

In the eleventh embodiment, as shown in FIG. 20, the manuscript stand 27 (contact glass 27') is formed as the optical element 52 and the semi-permeable area 52B is formed at the surface of the opposite side to the surface of the contact glass 27' facing the manuscript surface 28A. The remaining structure of the eleventh embodiment is substantially the same as the tenth embodiment. Hence, parts that are the same as the parts of the tenth embodiment are given the same reference numerals, and explanation thereof is omitted.

According to the eleventh embodiment, since the semi-permeable area 52B is formed at the contact glass 27', it is not necessary to provide the optical element 52 exclusively for reduction of the secondary lighting light. Hence, it is possible to easily make a layout of the lighting optical system and the image forming optical system and obtain a picture image of the manuscript having a high quality.

The structure where the semi-permeable area 52B is formed at the contact glass 27' can be applied to a manuscript reader apparatus by which the manuscript 28 is fed in the sub scanning direction, for example, by which the manuscript 28 is fed in the sub scanning direction by exclusively using the sheet document feeder 41.

Twelfth Embodiment

Figure 21:
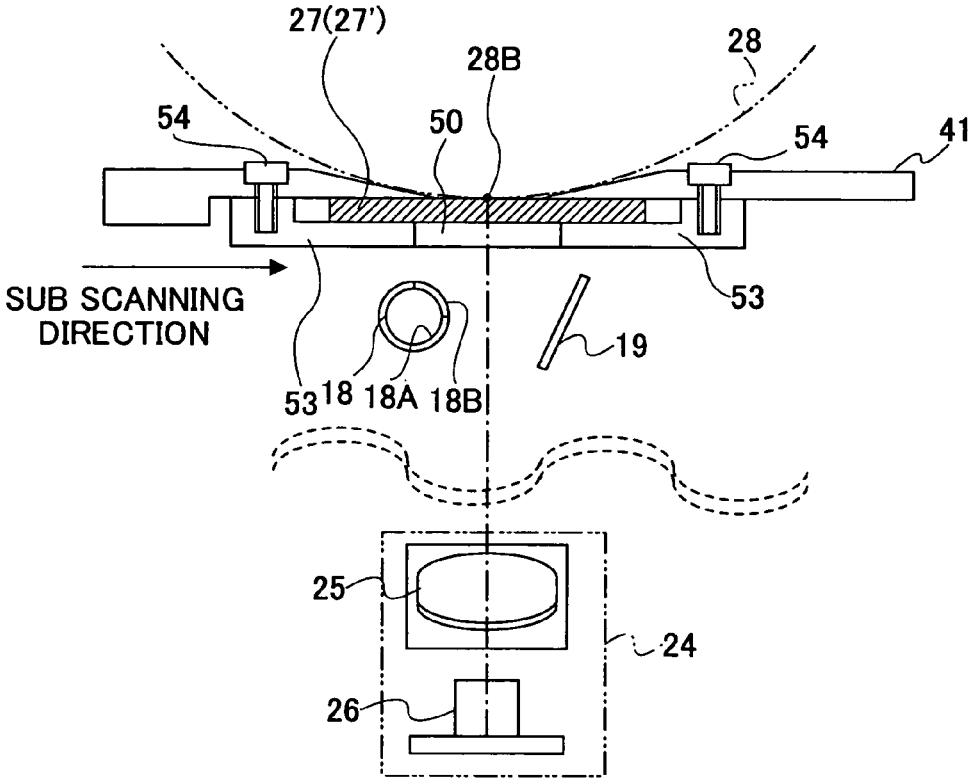
FIG. 21 is a schematic diagram showing a main part structure of an optical system of an image reader apparatus of a twelfth embodiment of the present invention and an example where a semi-permeable area is formed at a contact glass and the contact glass is adjustable.

In the twelfth embodiment, as shown in FIG. 21, supporting blankets 53 for supporting the contact glass 27' are provided at a lower part of the feeder main part 41. The contact glass 27' is supported in the sub scanning direction perpendicular to the main scanning direction in which the cylinder shaped lamp 18 extends and is adjustably supported in a direction parallel to the manuscript surface 28A. The contact glass 27' is fixed by fixing screws 54.

As well as in the eleventh embodiment, the whole permeable area 52A and the semi-permeable area 52B are formed at a surface at the opposite side to the surface facing to the manuscript surface 28A of the contact glass 27'.

According to the twelfth embodiment, it is possible to adjust the position of the contact glass based on the position of the image forming optical system. Hence, the position of the whole permeable area 52A can be adjusted corresponding to the position of the image sensor 26, and thereby it is possible to further improve the quality of reading the image.

The semi-permeable area 52B is far from the manuscript surface 28A. Hence, without reducing the reading light too much, the secondary lighting light P5 which is reflected at the manuscript surface 28A and diffusion-reflected at an inside part of the housing 10 can be reduced efficiently. That is, a lighting light unnecessary for image reading can be cut efficiently as a lighting light reflected from the vicinity of the reading part 28B of the manuscript surface 28A. Hence, the flare can be further reduced, so that it is possible to obtain a manuscript image having a high quality.

As shown in FIG. 21, the whole permeable area 52A and the semi-permeable area 52B are provided at the contact glass 27'. The whole of the contact glass 27' may be formed by an ND filter as the optical element 52.

Thirteenth Embodiment

Figure 22:
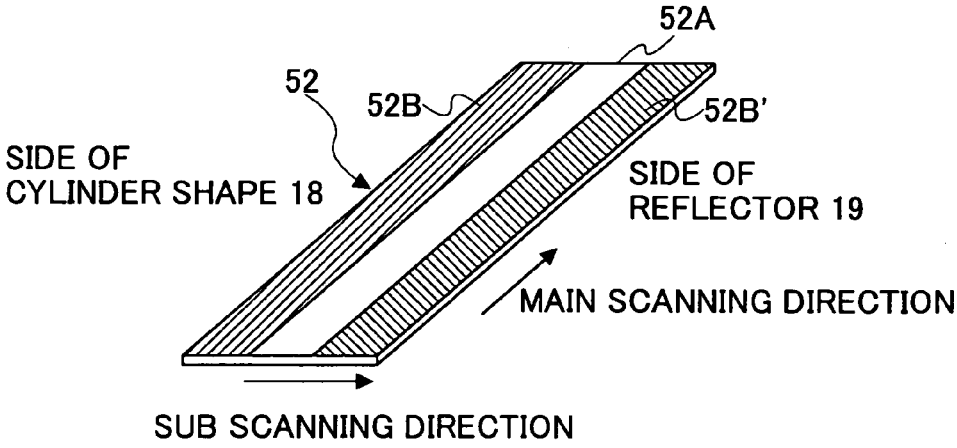
FIG. 22 is a perspective view showing an optical element of an image reader apparatus of a thirteenth embodiment of the present invention and for explaining a state where a permeability rate of a side of the cylinder shaped lamp is different from a permeability rate of a side of the reflector.

In the thirteenth embodiment, as shown in FIG. 22, in the optical element 52, the permeability rate of the semi-permeable area 52B' at a side of the reflector 19 by which a part of the lighting light from the cylinder shaped lamp 18 is reflected to the manuscript surface 28A so that the manuscript surface 18A is lighted, is set to be higher than the permeability rate of the semi-permeable area 52B at a side of the cylinder shaped lamp 18.

As described in the fourth embodiment, comparing the direct lighting light P2 which directly leads from the cylinder shaped lamp 18 to the reading part 28B and the lighting light P3 which is reflected by the reflector 19 and leads from a direction opposite to the direct lighting light P2 to the reading part 28B, the lighting light P3 which leads to the reading part 28B through the reflector 19 has a longer path. The strength of the lighting light P3 which leads to the reading part 28B through the reflector 19 is smaller than the strength of the direct lighting light P2 which leads to the reading part 28B. A ratio of the diffusion light which is diffused at the reading part 28B and returns to the irradiation opening part 18A of the cylinder shaped lamp 18 through the reflector 19 is small.

On the other hand, it is ideal in terms of obtaining a high quality reading image that the strength of the direct lighting light P2 which directly leads from the cylinder shaped lamp 18 to the reading part 28B be the same as the strength of the lighting light P3 which is reflected by the reflector 19 and leads from a direction opposite to the direct lighting light P2 to the reading part 28B. For example, there is an advantage that shade at the step part is not generated even for a manuscript part having a step.

According to the thirteenth embodiment, it is possible to make a balance of the secondary lighting light P5 at the side of the cylinder shaped lamp 18 and the reflector 19. Hence, even if the attenuation amount of the light of the primary lighting lights P2 and P3 is not large, it is possible to control the flare efficiently.

Fourteenth Embodiment

Figure 23:
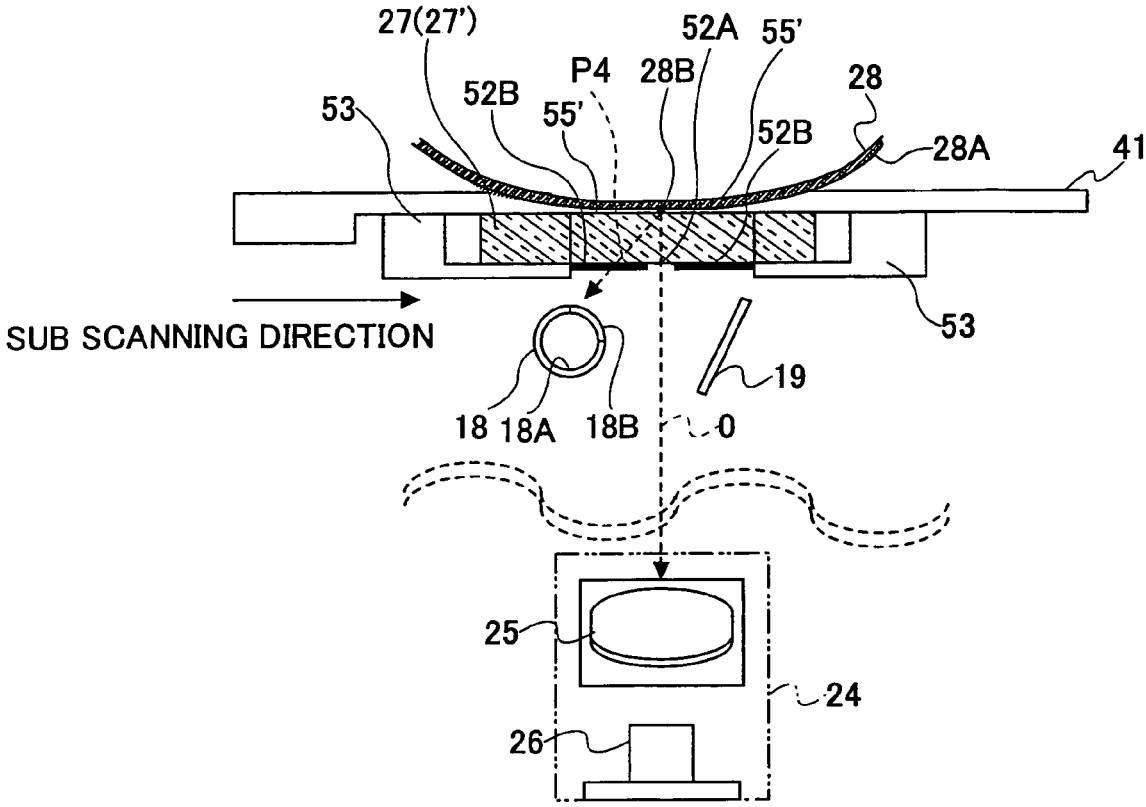
FIG. 23 is a schematic diagram showing an optical system of an image reader apparatus of a fourteenth embodiment of the present invention and a state where a non-permeable film is formed at the contact glass.

In the fourteenth embodiment, as shown in FIG. 23, the non-permeable films 55' are formed in areas other than the reading area 28B conjugate to the image sensor 26, at a surface at the side facing the manuscript surface 28A of the contact glass 17'.

According to the fourteenth embodiment, the lighting light injected from the cylinder shaped lamp 18 is attenuated, and then reaches the reading part 28B. The above-mentioned lighting light is diffusion-reflected based on the manuscript density of the reading part 28B.

According to the fourteenth embodiment, the reflection light from a part other than the reading part 28B is cut by the non-permeable films 55' regardless of the manuscript density. The secondary lighting light P5 is caused by the diffusion light P4, which is a reflecting light from the reading part 28B, and returning to the cylinder shaped lamp 18. However, since the semi-permeable area 52B is provided, the secondary lighting light from the cylinder shaped lamp 18 is reduced.

Fifteenth Embodiment

Figure 24:
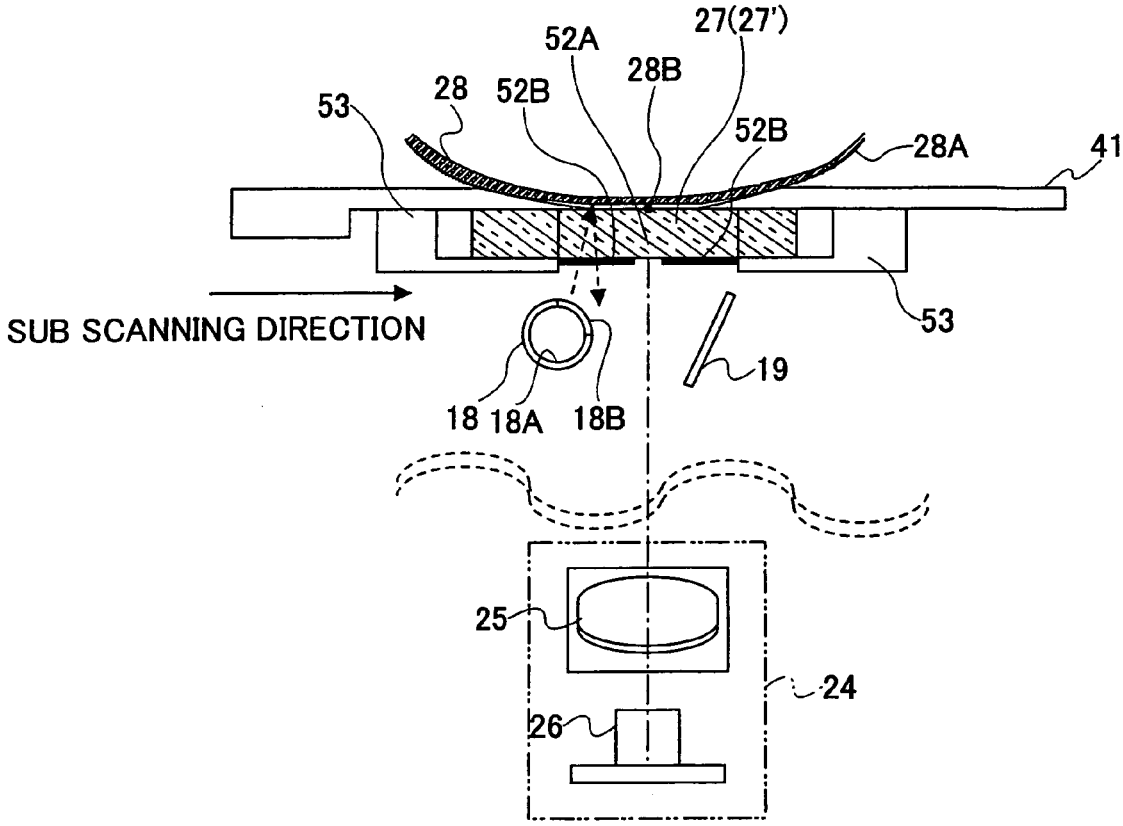
FIG. 24 is a schematic diagram showing an optical system of an image reader apparatus of a fifteenth embodiment of the present invention and a state where a semi-permeable area is formed at the contact glass and a permeability rate is gradually smaller as being further from a reading part.
Figure 25:
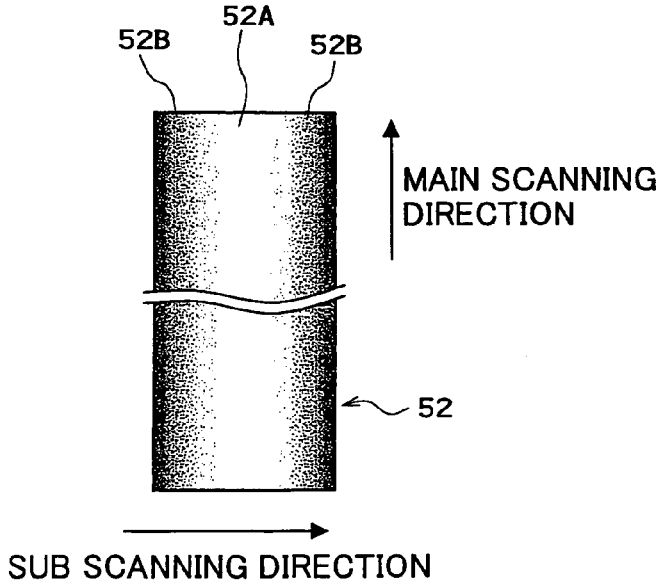
FIG. 25 is a plane view showing an example of the contact glass shown in FIG. 24.

In the fifteenth embodiment, as shown in FIG. 24 and FIG. 25, the permeability rate of the semi-permeable area 52B of the optical element 52 is set to be gradually smaller as being further from the reading part 28B.

The further the position of the reflection light of the lighting light which is lighted is from the reading part 28B, the more unnecessary is the reflection light for reading the manuscript 28. The more the unnecessary reflection light is, the more the attenuation of the secondary lighting light P5 is.

According to the fifteenth embodiment, the permeability rate of the semi-permeable area 52B of the optical element 52 is set to be smaller as being further from the reading part 28B. Hence, it is possible to eliminate the lighting light which does not contribute as the primary lighting light. As a result of this, the light amount of the secondary lighting light P5 can be reduced.

On the other hand, the reading part 28B is determined by a position relationship between the image forming lens 25 and the image sensor 26. If the above-mentioned position relationship is changed, the reading part 28B is also changed. However, according to the fifteenth embodiment, the semi-permeable area 52B is consecutively reduced from the permeability rate of the whole permeable area 52A. Hence, even if there is an unevenness at the position relationship between the image forming lens 25 and the image sensor 26, most of the lighting light permeates at the vicinity of the whole permeable area 52A of the semi-permeable area 52B. Therefore, it is possible to light the manuscript surface 28A without adjusting the position of the contact glass 27' (optical element 52) so that it is possible to prevent the image reading quality from being extremely worse.

Sixteenth Embodiment

Figure 26:
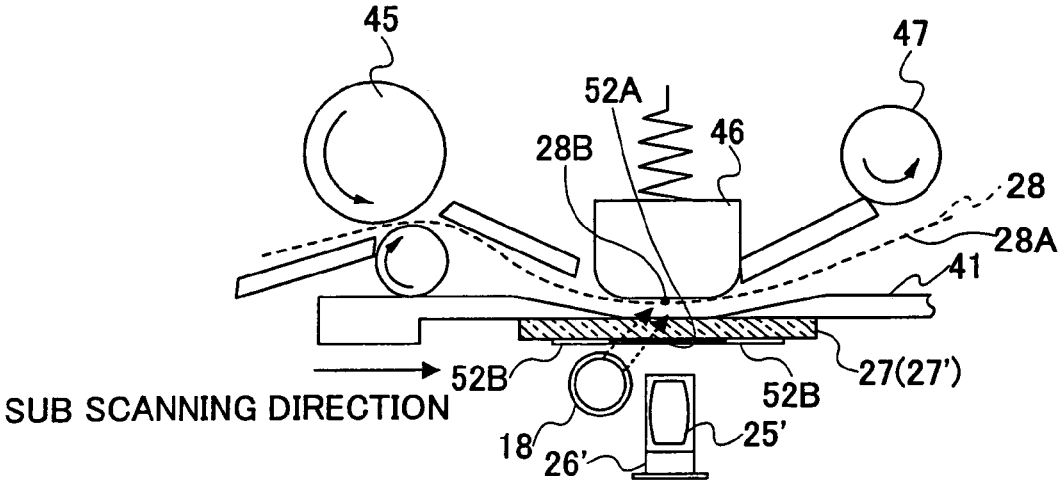
FIG. 26 is a schematic diagram showing an optical system of an image reader apparatus of a sixteenth embodiment of the present invention and an example applied to the same magnification optical system.

In the above-described tenth through fifteenth embodiments, the optical element 52 is provided at the image reader apparatus having a scaled-down optical element. However, as shown in FIG. 26, the optical element 52 may be provided at an image reader apparatus having the same magnification optical system comprising the same magnification image forming lens 25' and the same magnification sensor 26'.

Seventeenth Embodiment

Figure 27:
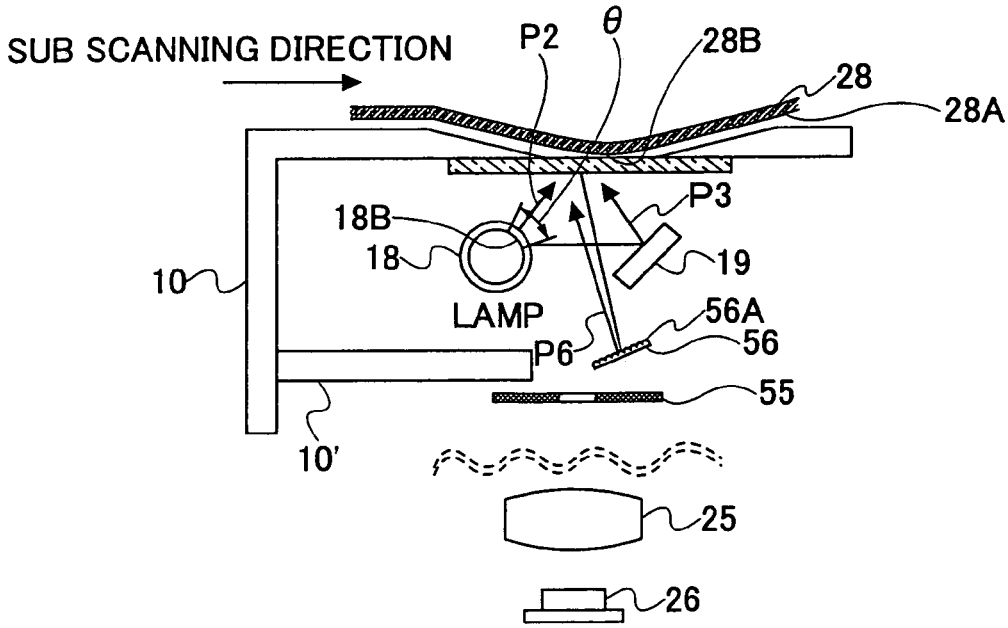
FIG. 27 is a schematic diagram showing an optical system of an image reader apparatus of a seventeenth embodiment of the present invention and a structure where a secondary lighting light is positively and diffusedly lighted at the manuscript surface.

In the seventeenth embodiment, as shown in FIG. 27, a document feeder 41 is fixed to the housing 10. The structure of the document feeder 41 is substantially the same as in the tenth embodiment 10 of the present invention. The contact glass 27' is fixed to the housing 10 so as to face the opening part. The cylinder shaped lamp 18 and the reflector 19 which form the lighting system are provided at the inside of the housing 10. The image forming optical system is provided at the inside of the housing 10. The image forming optical system mainly includes an aperture 55, the image forming lens 25, and the image sensor 26.

The optical element 56 having a diffusion reflection surface 56A by which a reflection light reflected from the manuscript surface 28A is diffusion-reflected to the manuscript surface 28A is provided at a position where the lighting light leading from the cylinder shaped lamp 18 to the manuscript surface 28A is not blocked and the optical path of the image forming optical system is not blocked, so as to be separated from the contact glass 27'.

According to the seventeenth embodiment, a part of the lighting light from the cylinder shaped lamp 18 directly lights the manuscript surface 28A, and a part of the remaining lighting light is reflected by the reflector 19 so as to light the manuscript surface 28A. The lighting light reaching the manuscript surface 28A is diffused based on the manuscript density. A part of the reflection light leads to the diffusion reflection surface 56A of the optical element 56, and is widely diffusion-reflected by the diffusion reflection surface 56A, so as to become a diffusion light P6.

Therefore, the diffusion reflection light widely lights the transcript surface 28A again, so that it is possible to prevent the secondary lighting light P5 due to the light and shade of the transcript 28 from lighting the original position again. Hence, the change of the light amount of the secondary lighting light P5 can be relatively reduced at the reading part where the drastic change of the density of the transcript surface 28A, namely an interface part of the white and black pattern, exists.

The diffusion reflection surface 56A of the optical element 56 may be formed of an optical material such as opal glass or white paint having a low gloss.

Figure 28:
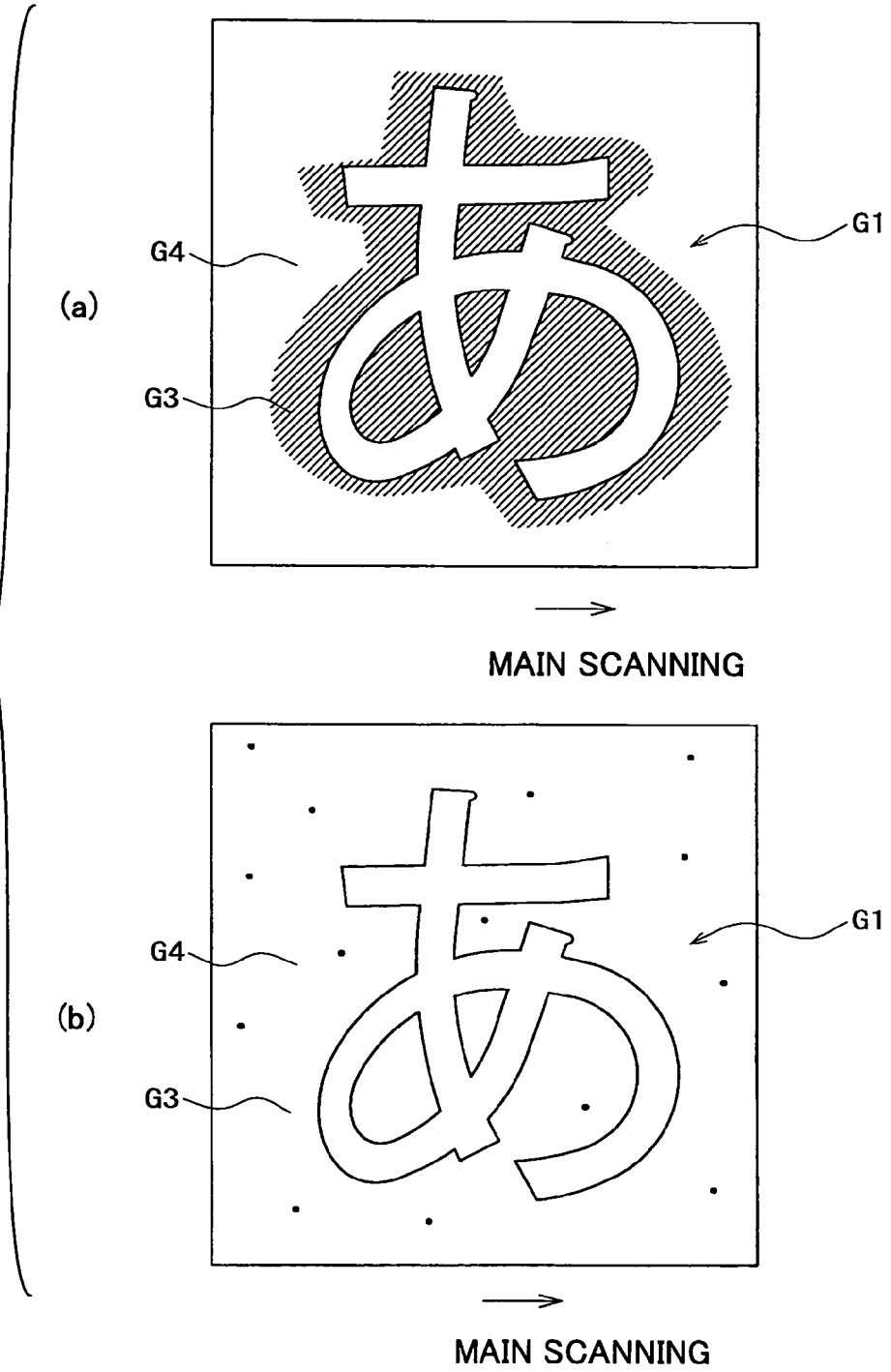
FIG. 28 is a comparison of images of a case where a manuscript image is read without the optical element shown in FIG. 27 and a case where a manuscript image is read with the optical element shown in FIG. 27; more specifically, FIG. 28-(*a*) shows the case where the manuscript image is read without the optical element shown in FIG. 27 and FIG. 28-(*b*) shows the case where the manuscript image is read with the optical element shown in FIG. 27.

FIG. 28 provides comparison images of a reading image G1 of the manuscript 28 in a case where the optical element 56 of the seventeenth embodiment is or is not provided at the housing 10. In a case where the optical element 56 of the seventeenth embodiment is not provided at the housing 10, as shown in FIG. 28-(*a*), a peripheral part of the character "あ" is dark due to lighting unevenness due to the secondary lighting light, and it is found, at first glance, that the reading quality of the character becomes worse. On the other hand, in a case where the optical element 56 of the seventeenth embodiment is provided at the housing 10, as shown in FIG. 28-(*b*), although a part having a white background is darker than the reading image G1 shown in FIG. 28-(*a*), the reflection light leading to the optical element 56 is diffused at the diffusion surface 56A by the lighting light reflected at the manuscript surface 28A being led to the manuscript surface 28A, and widely lights the manuscript surface 28A. Hence, the lighting unevenness due to the secondary lighting light P5 is reduced. Because of this, there becomes no difference between the peripheral part G3 of the character "あ" and the part G4 having a white background, and it is clear that reading quality of the charter is improved.

It is preferable for the distance between the diffusion reflection surface 56A and the manuscript surface 28A to be long. If the distance between the diffusion reflection surface 56A and the manuscript surface 28A is short, it is not possible to make the diffusion width large. As a result of this, the secondary lighting light P5 reflected at the manuscript surface 28A is reflected at the diffusion reflection surface 56A, so that the light to return to the substantially same reflection position as the original reflection position of the manuscript surface 28A increases. That is a reverse effect and is not preferable.

The distance between the diffusion reflection surface 56A and the manuscript surface 28A depends on the diffusion ability of the diffusion reflection surface 56A. It is preferable that the distance between the diffusion reflection surface 56A and the manuscript surface 28A be set so as to be longer than the distance between the cylinder shaped lamp 18 and the reading part 28B.

In a case where the cylinder shaped lamp 18 is an Xenon lamp, the inside part wall surface 18A is a white color diffusion surface due to the fluorescent agent. The reflection light reflected at the manuscript surface 28A is reflected by the white color diffusion surface so as to be the secondary lighting light P5, so that flare generation occurs. In a case of a standard image reader apparatus, the distance between the inside part wall surface 18A of the cylinder shaped lamp 18 and the manuscript reading part 28B is approximately 10 through 20 [mm]. If the distance between the diffusion reflection surface 55A and the reading part 28B is set to be approximately 10 through 20 [mm], an unevenness of the amount of lighting light occurs in a longitudinal direction of the cylinder shaped lamp 18. Hence, in a case where the reading size of the manuscript 28 of the image reader apparatus is A3 type, it is preferable that the distance between the diffusion reflection surface 56A and the reading part 28B be set equal or more than 30 [mm]. Considering the layout of the optical system, it is preferable that the distance between the diffusion reflection surface 56A and the reading part 28B be approximately 50 [mm].

In the seventeenth embodiment, the optical element 56 is separately provided. The diffusion reflection surface 56A may be formed on an upper surface of the aperture 55 so that the optical element 56 may be used as the aperture 55. The optical element 56 may be used at a structure wall 10' of an inside part of the housing 10.

As described in the third embodiment, it is preferable that the optical element 56 be set so that the reflection rate is low as the strength is high and the reflection rate is high as the strength is low, corresponding to the lighting light strength distribution in the main scanning direction.

Under the above-mentioned structure of the diffusion reflection surface 56A of the optical element 56, the reflection rate of the diffusion reflection surface 56A is lower as the strength is higher and the reflection rate of the diffusion reflection surface 56A is higher as the strength is lower, corresponding to the lighting amount distribution of the lighting light on the manuscript 28 in the direction which the cylinder shaped lamp 18 extends. Because of this, the strength difference between the secondary lighting light P5 generated at a part where the strengths of the primary lighting lights P2 and P3 are high and the secondary lighting light P5 generated at a part where the strengths of the primary lighting lights P2 and P3 are low, can be made small. As a result of this, it is possible to ease the lighting unevenness on the manuscript surface due to the strength distribution of the primary lighting light, so that it is possible to light the manuscript surface further uniformly.

Eighteenth Embodiment

Figure 29:
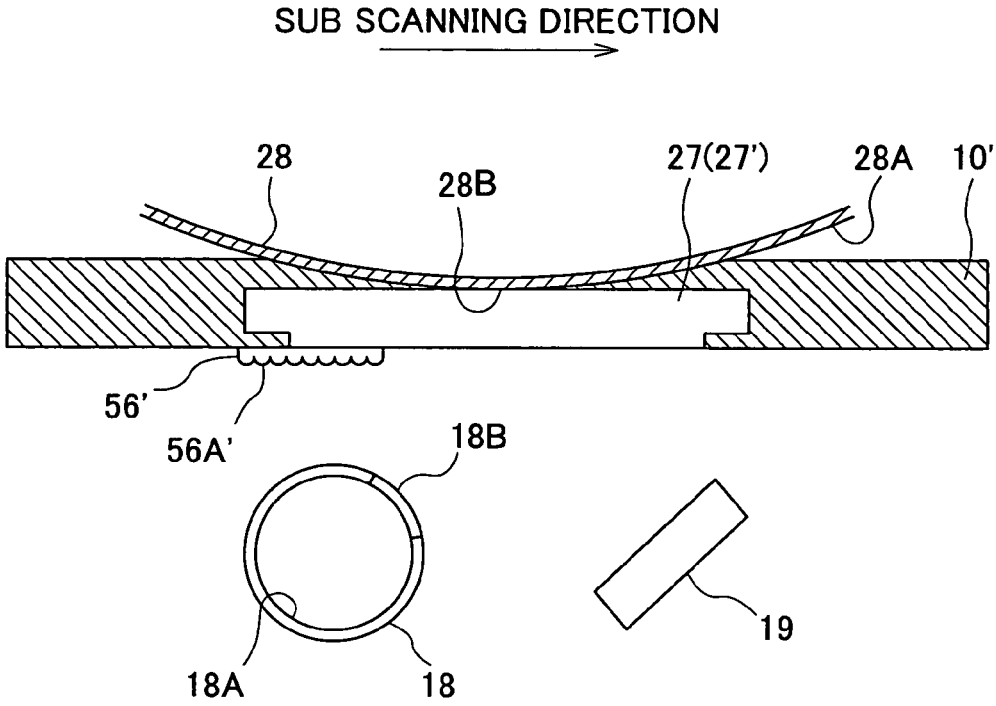
FIG. 29 is a cross-sectional view showing an optical system of an image reader apparatus of an eighteenth embodiment of the present invention and a structure where an optical element is provided at a back surface of a contact glass and a reflection light from the cylinder shaped lamp is diffusedly reflected in a direction far from the manuscript surface.

In the eighteenth embodiment, as shown in FIG. 29, the optical element 56' having a diffusion reflection surface 56A' by which the reflection light reflected by the manuscript surface 28A is diffusion-reflected is provided at a side opposite to the face facing the manuscript surface 28A of the contact glass 27' so as not to block the lighting light leading from the cylinder shaped lamp 18 to the manuscript surface 28A.

Figure 30:
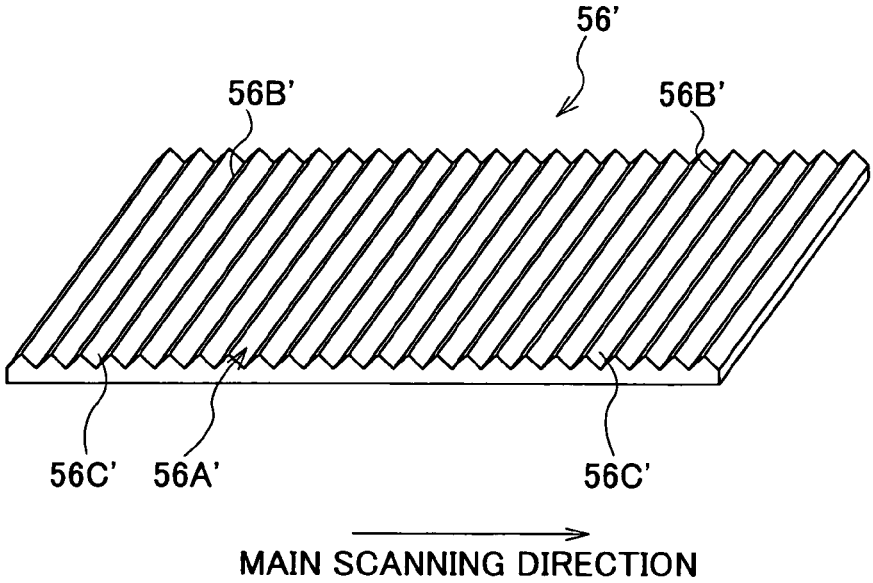
FIG. 30 is a perspective view of the optical element shown in FIG. 29.

The diffusion reflection surface 56A, as shown in FIG. 30, has a mountain part 56B' and a valley part 56C' which form a triangle cross-sectiona and extend in the main scanning direction which the cylinder shaped lamp extends. The mountain parts 56B' and the valley parts 56C' are provided alternatively in the sub scanning direction perpendicular to the main scanning direction.

Under the above-mentioned structure, a part of the lighting light injected from the cylinder shaped lamp 18 lights the reading part 28B, and a part of the remaining lighting light is reflected at the diffusion reflection surface 56A'. The part of the reflection light reflected at the diffusion reflection surface 56A' returns to the lighting optical system such as the cylinder shaped lamp 18, and is reflected by the optical element forming the lighting optical system so as to be the secondary lighting light P5 and leads to the manuscript surface 28A. Since the secondary lighting light P5, which is reflected by the diffusion reflection surface 56A' and reflected by the optical element of the lighting optical system, lights a wider range of the manuscript surface 28A again, the lighting effect of the secondary lighting light P5 is relatively reduced so that it is possible to prevent the light amount of the secondary lighting light P5 from changing even at a position where the manuscript density is changed drastically.

Furthermore, the diffusion reflection surface 56A, has a mountain part 56B' and a valley part 56C' which form a triangle cross-sectional view and extend in the main scanning direction. The mountain parts 56B' and the valley parts 56C' are provided alternatively in the sub scanning direction. Hence, lighting light reflected at the manuscript surface 28A is reflected in a direction being from an original reflection position so as to widely light the manuscript surface 28A.

It is preferable that the pitch between the mountain part 56B' and the adjacent mountain part 56B' or the pitch between the valley part 56C' to the adjacent valley part 56C' be equal to or less than twice as long as the image reader resolution.

For example, since a resolution of a standard image reading of the image reader apparatus (scanner) that is installed in a copy machine is 600 [dpi], one pixel is approximately 42.3 [μm]. It is preferable that a pitch between a mountain part and a mountain part (a valley part and a valley part) having a triangle cross-sectional configuration be equal to or less than 84.6 [μm]. If the diffusion reflection surface 56A' is formed with the above-mentioned pitch, it is possible to further diffuse the secondary lighting light P5 so that a partial lighting unevenness can be prevented.

Microscopically, the secondary lighting light unevenness corresponding to the mirror surface occurs in the main scanning direction. However, since the diffusion reflection surface 56A' having a triangle cross-sectional configuration is formed with a sufficiently short pitch against the resolution of the image reading, it is possible to light further uniformly regardless of the light and shade of the manuscript 28 so that the generation of lighting unevenness with a small period can be prevented.

It is preferable for the diffusion reflection surface 56A' of the optical element 56 to have a supplemental color relationship with a color of the peripheral part of the lighting optical system. That is, it is preferable for a spectral reflectance property of the diffusion reflection surface of the optical element to have a compensation relationship against a spectral reflectance property which is calculated by synthesizing an optical member such as a bracket provided at an inside part of the housing 10 located in an area where the secondary lighting light P5 reflected at the manuscript surface 28A reaches, such as a fluorescent surface of the Xenon lamp, and others.

Thus, if a color of the diffusion reflection surface 56A' has a supplemental color relationship with a color of the peripheral part of the lighting optical system, color of synthesized lights of the secondary lighting light P5 generated at the diffusion surface and the secondary lighting light P5 generated at the peripheral part of the lighting optical system is same as the color of the lighting light of the cylinder shaped lamp 18 so that the color of the manuscript 28 can reappear with a high precision.

If the above-mentioned process is not applied, a tinge of the secondary lighting light P5 is changed based on the spectral reflectance property at the peripheral part of the lighting optical system. In a case of a full color image reader apparatus, RGB reading values at the time when the image of the manuscript 28 is read are different from desirable values by design so that the color resolution ability of the image reader apparatus is reduced. However, according to this embodiment, precision for color reproduction is improved.

Nineteenth Embodiment

Figure 31:
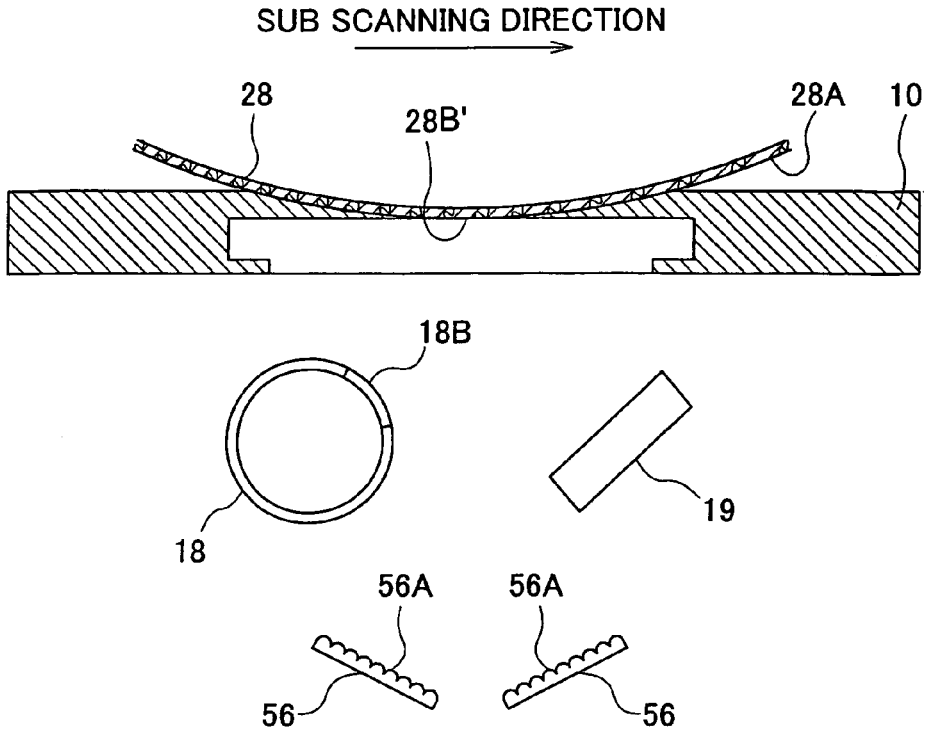
FIG. 31 is a cross-sectional view showing an optical system of an image reader apparatus of a nineteenth embodiment of the present invention and a state where an optical path of an image forming optical system is put between the optical elements and the optical elements are provided on both sides thereof.

In the nineteenth embodiment, as shown in FIG. 31, at least two optical elements 56 are provided so that the light part of the image forming optical system is put between the optical elements 56 and there is an interval in the perpendicular direction which the cylinder shaped lamp 18 extends.

Since the secondary lighting light P5 can be diffused more widely by the diffusion reflection surface 56A formed at the optical element 56 as the area of the diffusion reflection surface 56A is bigger, the manuscript surface 28A can be lighted uniformly regardless of the manuscript density. Although an arranging space at an inside part of the housing of the optical elements cannot be secured largely because the optical elements such as the cylinder shaped lamp (Xenon lamp) 18, the reflector 19, and the turning mirrors 20, 22, and 23 are provided inside of the housing 10, according to the nineteenth embodiment, an empty space at an inside of the housing 10 can be used effectively, since the optical elements 56 having the diffusion reflection surfaces are provided on both sides of the optical path of the image forming optical system, and the optical path is put between the optical elements 56. Hence, it is possible to light strongly and widely with the diffusion reflection light, and thereby the manuscript surface 28A can be lighted further uniformly regardless of the light and shade of the manuscript 28.

Furthermore, the secondary lighting light P5 is generated from both sides of the reading part. Hence, for example, even if the manuscript which has a difference in level of paper thickness due to patching is read out, it is difficult for the shade to occur the shade due to the difference in levels. Therefore, it is possible to improve the reading image quality wholly.

Twentieth Embodiment

Figure 32:
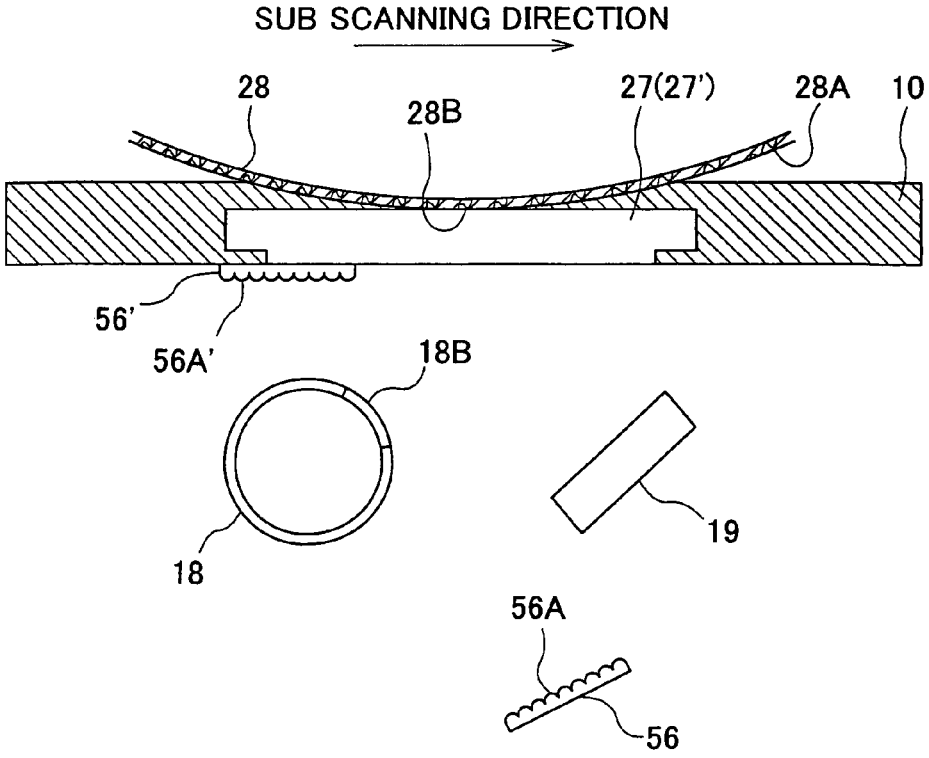
FIG. 32 is a cross-sectional view showing an optical system of an image reader apparatus of a twentieth embodiment of the present invention and a state where the structure shown in FIG. 27 is used together with the structure shown in FIG. 29.

In the twentieth embodiment, as shown in FIG. 32, the optical element 56 having the diffusion reflection surface 56A by which the reflection light reflected by the manuscript surface 28A is diffusion-reflected to the manuscript surface 28A, is provided at a position where the lighting light leading from the cylinder shaped lamp 18 to the manuscript surface 28A is not blocked and the optical path of the image forming optical system is not blocked, so as to be separated from the contact glass 27'. In addition, the optical element 56' having the diffusion reflection surface 56A' by which the reflection light reflected by the manuscript surface 28A is diffusion-reflected, is provided at a position where the lighting light leading from the cylinder shaped lamp 18 to the manuscript surface 28A is not blocked and at the side opposite to the surface of the contact glass 27' facing the manuscript surface 28A.

According to the twentieth embodiment, the diffusion-reflection surface 56A by which the reflection light reflected by the manuscript surface 28A is diffusion-reflected to the manuscript surface 28A, and the diffusion reflection surface 56A' for indirectly lighting the manuscript surface 28A by which the reflection light injected from the cylinder shaped lamp 18 is diffusion reflected in a direction opposite to the manuscript surface 28A, are provided. Hence, the light is reflected again to the manuscript surface 28A at the diffusion reflection surfaces 56A and 56A' of the optical elements 56, 56', respectively, and thereby it is possible to obtain stronger lighting light in a wide range regardless of the light and shade.

Twenty First Embodiment

Figure 33:
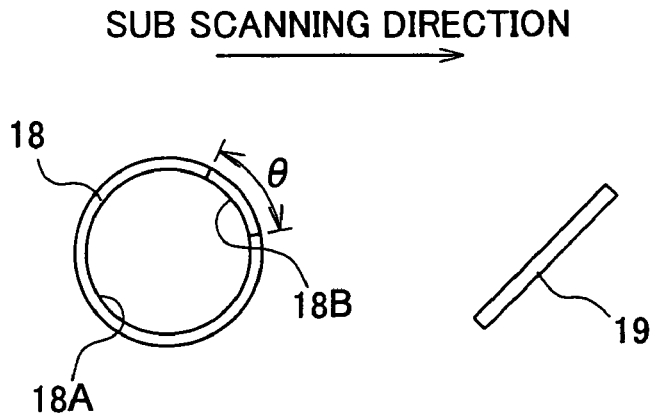
FIG. 33 is a cross-sectional view showing an optical system of an image reader apparatus of a 21st embodiment of the present invention and a cross-sectional view of the cylinder shaped lamp.

In the 21st embodiment, as shown in FIG. 33, the opening angle θ of the irradiation opening part 18B of the cylinder shaped lamp 18 is formed so as to be bigger than the opening angle θ of the irradiation opening part 18B of the cylinder shaped lamp 18 shown in FIG. 27, for example. As a result of this, the reading part in the sub scanning direction can be lighted widely.

According to the 21st embodiment, a greater range of the lighting light reaching the manuscript surface 28A can be obtained. Hence, it is possible to obtain re-lighting light from a wider range, and thereby the manuscript surface can be lighted uniformly regardless of the light and shade of the manuscript 28.

As described above, in the 21st embodiment, the opening angle θ of the irradiation opening part 18B of the cylinder shaped lamp 18 is formed so as to be bigger than the opening angle θ of the irradiation opening part 18B of the cylinder shaped lamp 18, so that the reading part in the sub scanning direction can be lighted widely. However, it is also possible for the reading part in the sub scanning direction to be lighted widely by making the position against the manuscript surface 28A of the reflector 19 and an area of the reflector 19 large.

Generally, it is preferable that the reflector 19 be curved so that the lighting light can be concentrated on the reading part 28B. In the twentieth embodiment, the reflector 19 is plane so that the concentration rate is intentionally reduced and the reading part in the sub scanning direction is made wider.

Twenty Second Embodiment

Figure 34:
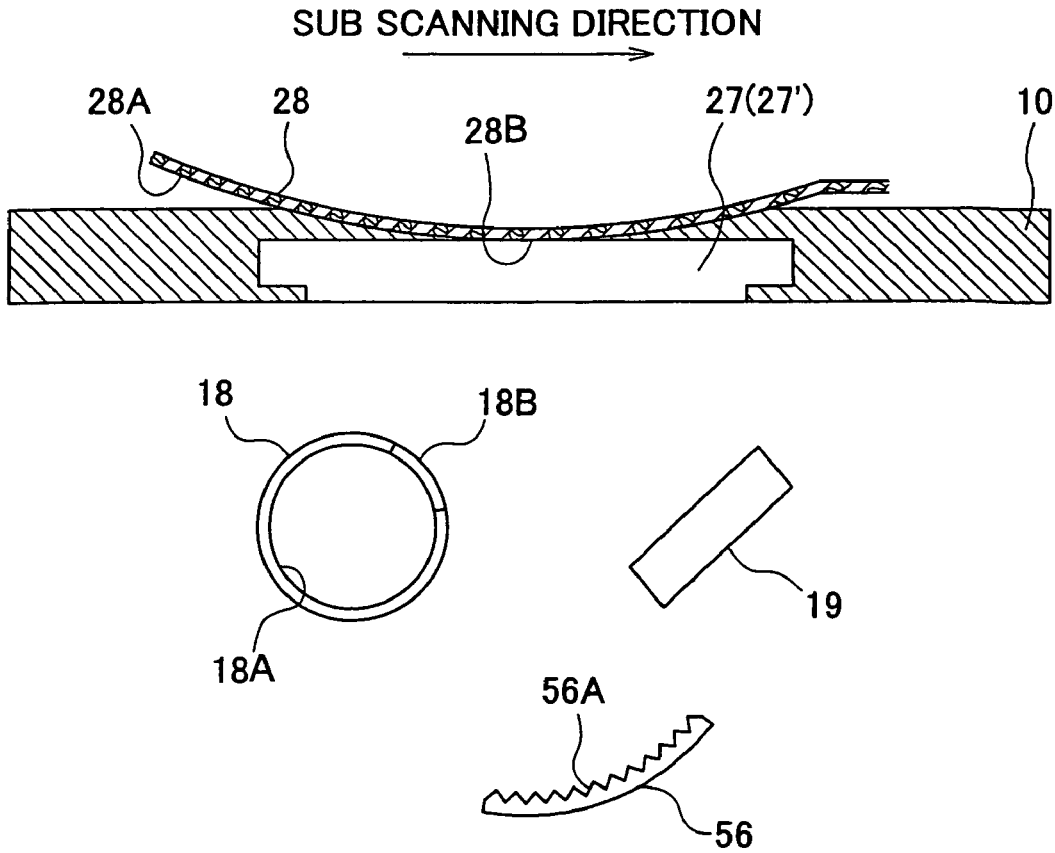
FIG. 34 is a cross-sectional view showing an optical system of an image reader apparatus of a 22nd embodiment of the present invention and a state where the diffusion reflection surface of the optical element is a curved surface.

In the 22nd embodiment, as shown in FIG. 34, the diffusion reflection surface 56A is formed by a curved surface in which the curvature center is situated at a side of the manuscript surface 28A. The cylinder shaped lamp 18 and the reflector 19 are designed and provided at the inside part of the housing 10 so that the light amount of the primary lighting light is maximum at the reading part, and therefore the reflection light from the vicinity of the reading part 28B is effectively concentrated. Furthermore, according to the 22nd embodiment, in a case where the diffusion reflection surface 56A is plane, the reflection light diffused in a direction far from the manuscript surface 28A can be reflected to the manuscript surface 28A. Hence, it is possible to concentrate more reflection lights on the manuscript surface 28A. Therefore, it is possible to light the manuscript surface 28A further uniformly regardless of the light and shade of the manuscript 28. It is more preferable that the curvature center be situated at the reading part.

The present invention is not limited to these embodiments, but variations and modifications may be made without departing from the scope of the present invention.

This patent application is based on Japanese priority patent applications No. 2003-16976 filed on Jan. 27, 2003 and No. 2003-314600 filed on Sep. 5, 2003, the entire contents of which are hereby incorporated by reference.

What is claimed is:

1. An image reader apparatus for lighting a manuscript surface of a manuscript, which is set on a manuscript stand, in a line state by a light source part, and for image-forming a reflection light from a reading part of the manuscript surface lighted in the line state, to an image sensor, by an image forming lens which forms a part of a scaled down optical system so that an image of the manuscript is read, comprising:

an irradiation opening part for irradiating a lighting light to an outside part, which is formed at the light source; and an ND filter for attenuating a light amount so as to be permeated, which is provided between the irradiation opening part and the manuscript stand.

2. An image reader apparatus for lighting a manuscript surface of a manuscript, which is set on a manuscript stand, in a line state by a cylinder shaped lamp, and for image-forming a reflection light from a reading part of the manuscript surface lighted in the line state, to an image sensor, by an image forming lens which forms a part of a scaled down optical system so that an image of the manuscript is read, comprising:

an irradiation opening part for irradiating a lighting light to an outside part, which is formed at the cylinder shaped lamp and extends in a direction which the lamp extends; and an ND filter for attenuating a light amount so as to be permeated, which is provided between the irradiation opening part and the manuscript stand.

3. The image reader apparatus as claimed in claim 2, wherein the cylinder shaped lamp is an Xenon lamp, and the ND filter is provided at the irradiation opening part.

4. The image reader apparatus as claimed in claim 2, wherein the cylinder shaped lamp is moved in a sub scanning direction perpendicular to a main scanning direction in which the cylinder shaped lamp extends, so that the manuscript surface of the manuscript is read.

5. The image reader apparatus as claimed in claim 2, wherein the ND filter has a surface to which a light absorbing process is applied.

6. The image reader apparatus as claimed in claim 2, wherein the ND filter has a surface to which a black net point process is applied.

7. The image reader apparatus as claimed in claim 2, wherein a permeability rate of the ND filter is set corresponding to an emission light strength distribution in a direction which the cylinder shaped lamp extends, so that the permeability rate is set small at a position where the emission light strength distribution is high, and the permeability rate is set large at a position where the emission light strength distribution is low.

8. The image reader apparatus as claimed in claim 2, wherein a reflector is provided so as to face the irradiation opening part of the cylinder shaped lamp, so that a lighting light from the cylinder shaped lamp is reflected and is led from a direction facing a direct lighting light that is directly led from the cylinder shaped lamp to the reading part, to the reading part, the ND filter has a permeable area where the direct lighting light which is directly led from the cylinder shaped lamp to the reading part is permeated, and a permeable area where the lighting light which is led to the reflector is permeated, and a permeability rate of the permeable area where the lighting light which is led to the reflector is permeated is larger than a permeability rate of the permeable area where the direct lighting light is permeated.

9. The image reader apparatus as claimed in claim 2, wherein a reflector is provided so as to face the irradiation opening part of the cylinder shaped lamp, so that a lighting light from the cylinder shaped lamp is reflected and is led from a direction facing a direct lighting light, which direct lighting light is directly led from the cylinder shaped lamp to the reading part, to the reading part, the ND filter has a permeable area where the direct lighting light which is directly led from the cylinder shaped lamp to the reading part is permeated, and a permeable area where the lighting light which is led to the reflector is permeated, and a permeability rate of the permeable area where the lighting light which is led to the reflector is progressively larger, from the permeable area where the direct lighting light which is directly led from the cylinder shaped lamp to the reading part is permeated, to the permeated area where the lighting light which is led to the reflector is permeated.

10. The image reader apparatus as claimed in claim 2, wherein the ND filter shows a color having a supplemental relationship with an emission color of the cylinder shaped lamp.

11. The image reader apparatus as claimed in claim 2, wherein the ND filter cuts a lighting light in an infrared wave length area.

12. The image reader apparatus as claimed in claim 2, wherein the ND filter is formed by a polarization filter.

13. The image reader apparatus as claimed in claim 2, wherein the ND filter is provided so as to be tilted against a segment perpendicularly connecting a center axis of the cylinder shaped lamp and the reading part.

14. The image reader apparatus as claimed in claim 2, wherein a revolving mechanism for rotating the ND filter in a state where a rotational shaft situated in parallel to a direction in which the cylinder shape extends is a center of rotation, so that the optical element can be fixed.

15. The image reader apparatus as claimed in claim 2, wherein the ND filter is provided so as to be separated from the cylinder shaped lamp, and has a surface facing the cylinder shaped lamp that is a curved surface which curves along an external form of the cylinder shaped lamp.

* * * * *